US009052663B2

(12) United States Patent
Suzuki et al.

(10) Patent No.: US 9,052,663 B2
(45) Date of Patent: Jun. 9, 2015

(54) IMAGE FORMING APPARATUS

(71) Applicants: Shingo Suzuki, Kanagawa (JP); Satoshi Kaneko, Kanagawa (JP); Shuji Hirai, Tokyo (JP); Koichi Kudo, Kanagawa (JP); Jun Yamane, Kanagawa (JP); Shinji Kato, Kanagawa (JP)

(72) Inventors: Shingo Suzuki, Kanagawa (JP); Satoshi Kaneko, Kanagawa (JP); Shuji Hirai, Tokyo (JP); Koichi Kudo, Kanagawa (JP); Jun Yamane, Kanagawa (JP); Shinji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/227,169

(22) Filed: Mar. 27, 2014

(65) Prior Publication Data

US 2014/0301748 A1 Oct. 9, 2014

(30) Foreign Application Priority Data

Apr. 4, 2013 (JP) ..... 2013-078384

(51) Int. Cl.
*G03G 15/00* (2006.01)
*G03G 15/06* (2006.01)

(52) U.S. Cl.
CPC ..... *G03G 15/5025* (2013.01); *G03G 15/065* (2013.01); *G03G 15/5058* (2013.01)

(58) Field of Classification Search
CPC ..... G03G 15/5025; G03G 15/5058; G03G 15/065
See application file for complete search history.

(56) References Cited

U.S. PATENT DOCUMENTS

| | | | | |
|---|---|---|---|---|
| 7,489,884 | B2 * | 2/2009 | Ichikawa et al. | 399/49 |
| 2005/0047834 | A1 * | 3/2005 | Tomita et al. | 399/301 |
| 2013/0108288 | A1 | 5/2013 | Kaneko et al. | |
| 2013/0108292 | A1 | 5/2013 | Suzuki et al. | |
| 2013/0243456 | A1 | 9/2013 | Kaneko et al. | |
| 2013/0243457 | A1 | 9/2013 | Kaneko et al. | |
| 2014/0169814 | A1 * | 6/2014 | Uematsu et al. | 399/49 |

FOREIGN PATENT DOCUMENTS

| | | |
|---|---|---|
| JP | H09-062042 | 3/1997 |
| JP | 2000-098675 | 4/2000 |

* cited by examiner

*Primary Examiner* — Ryan Walsh
(74) *Attorney, Agent, or Firm* — Oblon, McClelland, Maier & Neustadt, L.L.P.

(57) ABSTRACT

An image forming apparatus includes an image carrier; an image forming unit; a processor for controlling the image forming unit according to a predetermined image forming condition setting data; an image density sensor to detect an image density of the toner pattern formed on the image carrier; a reference rotary position detector; an image density fluctuation data acquisition unit to obtain an image density fluctuation data of more than one circumferential length of the photoreceptor drum with reference to the reference rotary position detected by the reference rotary position detector based on a result related to the toner pattern formed on the image carrier detected by the image density sensor; and a correction data generator to generate a correction data to correct a reference image forming condition setting data with a correction amount corresponding to each rotary position of the rotary member to thus reduce the image density fluctuation.

10 Claims, 25 Drawing Sheets

IMAGE FORMING APPARATUS

CROSS-REFERENCE TO RELATED APPLICATION

The present application claims priority pursuant to 35 U.S.C. §119(a) from Japanese patent application number 2013-078384, filed on Apr. 4, 2013, the entire disclosure of which is incorporated by reference herein.

BACKGROUND

1. Technical Field

The present invention relates to an image forming apparatus such as a copier, a printer, a facsimile machine, and the like, and in particular to an image forming apparatus employing electrophotography to form images.

2. Related Art

In image forming apparatuses employing electrophotography, a surface of an image carrier such as a photoreceptor is uniformly charged by a charger; an electrostatic latent image is formed on the surface of the image carrier by an exposure device; and a developing device adheres toner onto the electrostatic latent image to thus form a toner image. Such image forming apparatuses are widely used not only in the business offices but in industrial printing because of ease of draft generation and correction and acute demand for ever higher output speed and quality.

Of those various quality requirements, uniform density over any given printed page is highly demanded and the uniformity in the printed page is a decision factor when a user selects an image forming apparatus. Accordingly, suppressing density fluctuation in the printed page is most important. It is known that density fluctuation occurs due to various factors. Those factors include, for example, uneven charging or charging fluctuation when the charger electrically charges the surface of the image carrier; fluctuation of exposure by the exposure unit; eccentric rotation and variations in sensitivity of an image carrier such as a photoreceptor; eccentric rotation or variations in the resistance of a developer carrier such as a developing roller; fluctuation in the charge of the toner; and variations in the transferring of a transfer roller.

Among those factors, eccentric rotation or sensitivity fluctuation of the image carrier (being a rotary member) in the rotational direction, and eccentric rotation or variations in the electrical resistance of the developer carrier (being a rotary member) in the rotational direction are prominent. In general, the image carrier and the developer carrier are rotated more than once to form a toner image to be formed in one image, i.e., one page image. Thus, a cyclic image density fluctuation is generated due to the above factors, and the image density fluctuation appearing in the formed image is easily apparent. Therefore, minimizing image density fluctuation is paramount.

JP-H09-062042-A discloses an image forming apparatus in which cyclic density fluctuation data is stored for the purpose of exclusively reducing the stripe-shaped density fluctuation generated cyclically in the output image and image forming conditions are adjusted based on the density fluctuations data. According to this image forming apparatus, the density fluctuations data (i.e., the image density fluctuation data) corresponding to at least one rotary cycle of the developer carrier is stored, and any one of charge voltage, exposure light amount, developing voltage, and transfer voltage is adjusted to reduce the image density fluctuation corresponding to the density fluctuations data. Similarly, JP-2000-98675-A discloses an image forming apparatus in which the image density fluctuation of the developer carrier having a rotation cycle is reduced by adjusting image processing conditions in accordance with one rotary cycle of the developer carrier.

The mechanism by which image density fluctuates due to the eccentric rotation of the image carrier or the developer carrier will be described in detail using the eccentric rotation of the image carrier as an example.

An electric potential difference is created between the image carrier and the developer carrier disposed opposite and in the vicinity of the image carrier and a developing bias is applied to the developing area, so that an electric field is generated in the developing area. Toner is transferred onto an electrostatic image formed on the surface of the image carrier by the electric field and is adhered thereon to form a toner image. If the image carrier suffers from eccentric rotation, it gets out of synch with the developer carrier. Thus, even though the developing bias is kept constant, the electric field strength in the developing area fluctuates with the rotary cycle of the image carrier. Because a toner deposition amount per unit area adhered onto the electrostatic latent image changes relative to the electric field strength in the developing area, if the image carrier does not rotate at a constant speed, the toner deposition amount per unit area changes in accordance with the rotary cycle of the image carrier even though the same image density is to be obtained. The same applies to the eccentric rotation of the developer carrier.

In addition, the sensitivity fluctuation of the image carrier in the rotary direction of the image carrier changes the potential of the electrostatic latent image portion on the surface of the image carrier, so that the potential difference between the electrostatic latent image portion on the surface of the image carrier and the developer carrier changes during the rotary cycle of the image carrier. As a result, when the sensitivity fluctuation exists in the rotary direction of the image carrier, the toner deposition amount per unit area to be adhered on the electrostatic latent image changes even though the same image density is to be obtained. The same applies to the variations in the resistance of the developer carrier in the rotary direction of the developer carrier.

SUMMARY

The present invention provides an improved image forming apparatus capable of optimally reducing the image density fluctuation having a rotary cycle of the rotary member that includes an image carrier; a rotary member; an image forming unit to form a toner image on a surface of the image carrier to ultimately transfer the toner image onto a recording medium. The image forming unit forms a toner pattern having a length greater than the circumference of the rotary member on the surface of the intermediate transfer belt for use in detecting image density of a formed image. The image forming apparatus further includes a processor for controlling the image forming unit using predetermined image forming condition setting data; an image density sensor to detect image density of the toner pattern formed on the surface of the intermediate transfer belt; a reference rotary position detector to detect a reference rotary position of the rotary member of the image forming unit; an image density fluctuation data acquisition unit to obtain an image density fluctuation data of more than one circumferential length of the rotary member with reference to the reference rotary position detected by the reference rotary position detector based on the image density of the toner pattern formed on the intermediate transfer belt detected by the image density sensor; and a correction data generator to generate correction data to correct reference image forming condition setting data by a correction amount corresponding to each rotary position of the rotary member to reduce the image density fluctuation of one rotary cycle of the rotary member obtained by the image density fluctuation data with reference to the reference rotary position, In the optimal image forming apparatus, the processor starts to control image formation in accordance with the image forming condition setting data after correction by the correction data each time the reference rotary position detector detects the reference rotary position of the rotary member a predetermined number of times at a control start timing based on the detected timing, and when the reference rotary position detector does not detect the reference rotary position of the rotary member by the time a correction control stop timing to complete the image forming control arrives, the processor starts image forming control in accordance with the image forming condition setting data after correction following the control stop timing.

These and other objects, features, and advantages of the present invention will become apparent upon consideration of the following description of the preferred embodiments of the present invention when taken in conjunction with the accompanying drawings.

BRIEF DESCRIPTION OF THE DRAWINGS

FIG. 26(*b*) is a timing chart to show a timing to stop the correction control of the developing bias when a predetermined time has passed but the home position has not been detected since the home position was detected for the last time;

DETAILED DESCRIPTION

Hereinafter, an embodiment of an image forming apparatus will be described referring to accompanying drawings.

Figure 1:
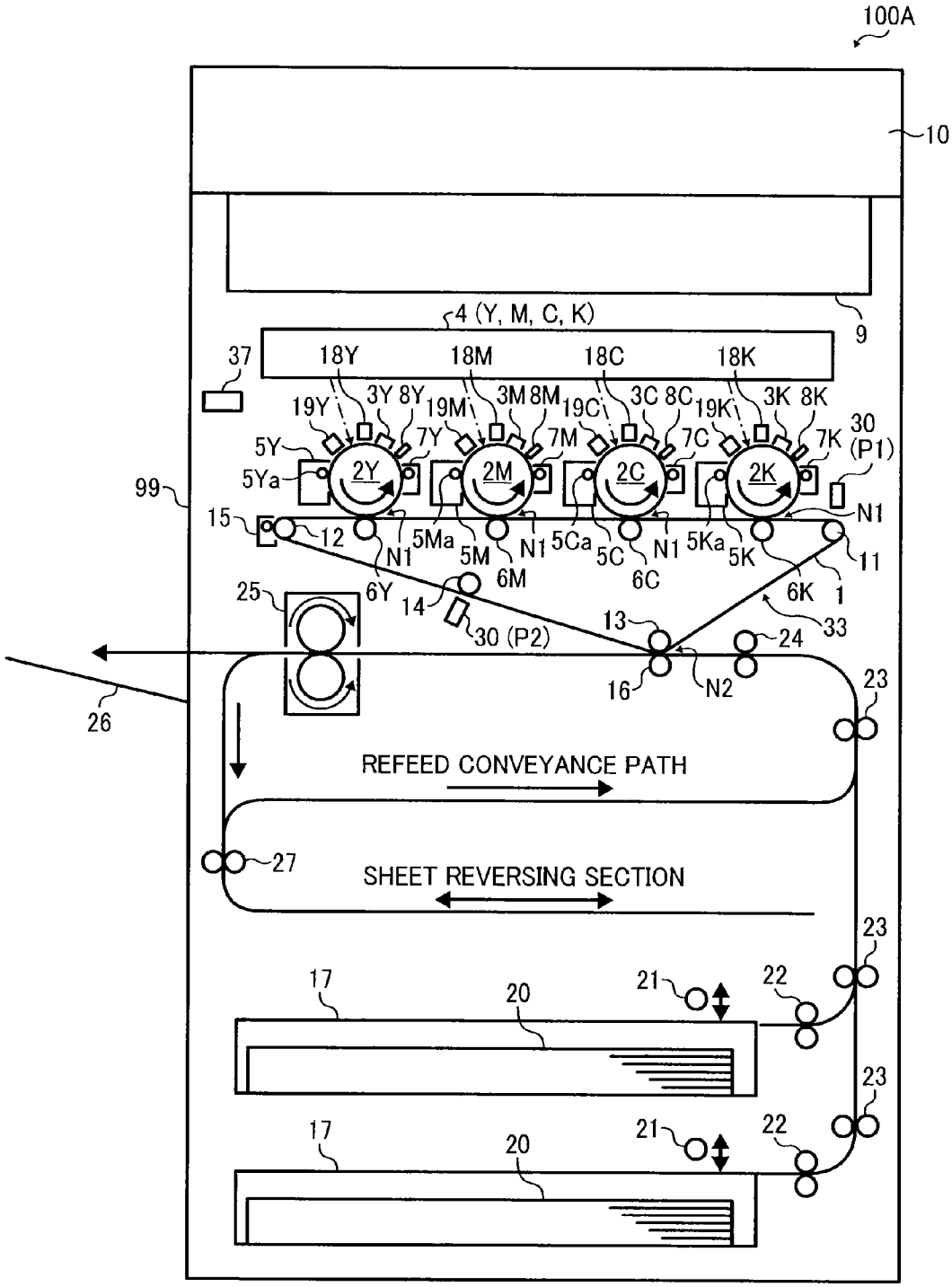
FIG. 1 illustrates a schematic configuration of an image forming apparatus according to an embodiment of the present invention.

FIG. 1 is a general configuration of the image forming apparatus according to the embodiment of the present invention.

As illustrated in FIG. 1, a full-color apparatus employing a four-storied, tandem-type intermediate transfer configuration is shown as an example of the present invention. It is to be noted that the present invention may be applied to other types of image forming apparatuses including a four-storied, tandem-type direct transfer configuration for a full color machine or a single-drum-type intermediated transfer configuration for a full color apparatus, a single-drum-type direct transfer configuration for a monochrome machine, and the like.

As illustrated in FIG. 1, the image forming apparatus 100A includes an intermediate transfer belt 1 as an image carrier and photoreceptor drums 2Y, 2M, 2C, and 2K as rotary members to carry an image thereon as a latent image carrier. The photoreceptor drums are disposed in parallel along a stretched surface of the intermediate transfer belt 1. The suffixes Y, M, C, and K represent yellow, magenta, cyan, and black, respectively.

A structure of a yellow image forming station will be described as representative. In the order of the rotation direction of the photoreceptor drum 2Y, a charger 3Y, a photointerrupter 18Y, an optical write unit 4Y, a surface potential sensor 19Y, a developing unit 5Y, a primary transfer roller 6Y, a photoreceptor cleaning unit 7Y, and a neutralizing lamp QL 8Y as a discharger are disposed around the photoreceptor drum 2Y. The photointerrupter 18Y detects a reference rotary position, also known as a home position, of the photoreceptor drum 2Y, thereby acting as a reference rotary position detection unit. The optical write unit 4Y exposes a surface of the photoreceptor drum 2Y to write an electrostatic latent image thereon. The surface potential sensor 19Y detects an electric potential on the surface of the photoreceptor drum 2Y. The photoreceptor cleaning unit 7Y, which includes a blade and a brush, not shown, cleans a surface of the latent image carrier.

A toner image forming unit to form a toner image on the intermediate transfer belt 1 is implemented by the photoreceptor drum 2Y, the charger 3Y, the optical write unit 4Y, the developing unit 5Y, the primary transfer roller 6Y, and the like. Toner image formation by other image forming stations is similarly performed.

The intermediate transfer belt 1 is rotatably supported by rollers 11, 12, and 13. A belt cleaning unit 15 is disposed opposite the roller 12. The belt cleaning unit 15 includes a blade and a brush, both not shown. The intermediate transfer belt 1, rollers 11, 12, and 13, and the belt cleaning unit 15 together form an intermediate transfer unit 33. A secondary transfer roller 16 as a secondary transfer unit is disposed opposite the roller 13.

A scanner 9 as an image reading unit and an automatic document feeder (ADF) 10 are disposed above the optical write unit 4. Multiple paper trays 17 are disposed in the bottom of the main body 99 of the image forming apparatus 100A. A recording sheet 20 as a recording medium contained in each paper tray 17 is picked up by a pickup roller 21 and a sheet feed roller pair 22 and conveyed by a conveyance roller pair 23. The recording sheet 24 is then conveyed by a registration roller pair 24 at a predetermined timing to a secondary transfer nip N2, as a secondary transfer area, where the intermediate transfer belt 1 and a secondary transfer roller 16 are opposite each other. A fixing unit 25 is disposed downstream of the secondary transfer nip N2 in the sheet conveyance direction.

The image forming unit to form a toner image on the surface of each photoreceptor drum 2Y, 2M, 2C, and 2K and finally transfer the toner image onto the recording sheet 20 is implemented by four image forming stations, the optical write unit 4, the intermediate transfer unit 33, and the secondary transfer roller 16, each of which is a member relating to image formation.

In FIG. 1, a sheet discharge tray 26 is disposed at a side of the main body of the image forming apparatus. Reference numeral 27 represents a switchback roller pair and 37 represents a controller including a CPU, a nonvolatile memory, a flash memory, and the like.

Each of the developing units 5Y, 5M, 5C, and 5K includes a developing roller 5Ya, 5Ma, 5Ca, and 5Ka, respectively. Each developing roller as a rotary developer carrier is disposed opposite the corresponding photoreceptor drum 2Y, 2M, 2C, or 2K with a certain distance, that is, a development gap. The developing rollers 5Ya, 5Ma, 5Ca, and 5Ka each carry two-component developer including toner and a carrier contained in the developing units 5Y, 5C, 5K, and 5K, respectively. The toner included in the two-component developer is adhered to the photoreceptor drums 2Y, 2M, 2C, and 2K at a developing nip where the photoreceptor drum and the developing roller are opposed, thereby forming an image on each of the photoreceptor drums 2Y, 2M, 2C, and 2K.

A sensor panel including a slit is fixed on a rotary axis of each photoreceptor drum and rotates together with the photoreceptor drum. Each time the photoreceptor drum rotates once, the sensor panel rotates one revolution, so that the slit of the sensor panel passes a detection area of the transmission-type photointerrupter 18Y, 18M, 18C, or 18K. When the part of the sensor panel other than the slit exists in the detection area, an optical path of the photointerrupter is blocked, so that the output signal is off. When the slit exists in the detection area, the optical path of the photointerrupter is not blocked, so that the output signal is on. Each time the photoreceptor drum rotates once, the home position as a reference rotary position of the photoreceptor drum can be detected from the detection signal from the photointerrupter.

In the present embodiment, as a reference rotary position sensor, the photointerrupters 18Y, 18M, 18C, and 18K are used; however, any other unit such as a rotary encoder may be alternatively used as long as rotary position can be detected. Similarly, a rotary position sensor for detecting a reference rotary position of the developing rollers 5Ya, 5Ma, 5Ca, and 5Ka can be implemented similarly to the above unit.

Surface potential sensors 19Y, 19M, 19C, and 19K each detect a potential of the electrostatic latent image on each surface of the photoreceptor drums 2Y, 2M, 2C, and 2K written by the optical write units 4Y, 4M, 4C, and 4K, that is, before the electrostatic latent image on the photoreceptor drum 2Y, 2M, 2C, or 2K is supplied with toner and developed. The detected surface potential is fed back as setting information of process conditions, such as charging bias of the chargers 3Y, 3M, 3C, and 3K, and laser power of the optical write units 4Y, 4M, 4C, and 4K, and is used to maintain stable image density.

The optical write units 4Y, 4M, 4C, and 4K each drive four semiconductor lasers, not shown, based on image data by way of laser controller, not shown, and radiate four writing beams to expose each of the photoreceptor drums 2Y, 2M, 2C, and 2K which is uniformly charged in the dark by the chargers 3Y, 3M, 3C, and 3K, respectively. The optical write unit 4 scans each of the photoreceptor drums 2Y, 2M, 2C, and 2K in the dark by the writing optical beams so that an electrostatic latent image for the colors of Y, M, C, and K is written on the surface of each of the photoreceptor drums 2Y, 2M, 2C, and 2K. In the present embodiment, such an optical write unit 4Y, 4M, 4C, or 4K is used in which, while laser beams emitted from the semiconductor laser are being deflected by a polygon mirror, not shown, the deflected laser beams are reflected by a reflection mirror or are penetrated into an optical lens, so that optical scanning is performed. As an optical writing unit 4, the one writing the electrostatic latent image by LED arrays may be used alternatively.

Referring to FIG. 1, an image forming operation will be described.

Upon a print start command is input, each roller around the photoreceptor drums 2Y, 2M, 2C, and 2K, around the intermediate transfer belt 1 and along the sheet conveyance path starts to rotate at a predetermined timing, and a recording sheet is started to be fed from the paper tray 17. Meanwhile, each surface of the photoreceptor drums 2Y, 2M, 2C, and 2K is charged uniformly by the charger 3Y, 3M, 3C, and 3K, and is exposed, based on each image data, by light radiated from the optical write units 4Y, 4M, 4C, and 4K. The electric potential pattern thus formed on the surface of the photoreceptor drums 2Y, 2M, 2C, and 2K after exposure is called an electrostatic latent image. The surface of the photoreceptor drums 2Y, 2M, 2C, and 2K carrying the electrostatic latent image thereon is supplied with toner from the developing units 5Y, 5M, 5C, and 5K. Then, the electrostatic latent image carried on the photoreceptor drums 2Y, 2M, 2C, and 2K is developed into a toner image.

In the structure as illustrated in FIG. 1, the photoreceptor drums 2Y, 2M, 2C, and 2K are provided for four colors of yellow, magenta, cyan, and black, of which the order is different from system to system. Accordingly, a toner image of yellow, magenta, cyan, or black is developed on a corresponding photoreceptor drum 2Y, 2M, 2C, or 2K. The photoreceptor drums 2Y, 2M, 2C, and 2K are opposed to the intermediate transfer belt 1 in the primary transfer nip N1 as a primary transfer area. Primary transfer rollers 6Y, 6M, 6C, 6K are disposed opposite the photoreceptor drums 2Y, 2M, 2C, and 2K, respectively, so that primary transfer bias and pressure are applied to the primary transfer nip N1. The toner image developed on each of the photoreceptor drums 2Y, 2M, 2C, and 2K is then transferred to the intermediate transfer belt 1 by the primary transfer bias and pressure applied to the primary transfer rollers 6Y, 6M, 6C, and 6K at the primary transfer nip N1. The primary transfer operation as above is repeated for all four colors by adjusting the timing of transfer, so that a full color toner image is formed on the intermediate transfer belt 1.

The full-color toner image formed on the intermediate transfer belt 1 is transferred at a secondary transfer nip N2 onto the recording sheet 20 which is conveyed at a proper timing as adjusted by the registration roller pair 24. At this time, a secondary transfer is performed by a secondary transfer bias and pressing force applied to a secondary transfer roller 16. The recording sheet 20 onto which a full color toner image has been transferred passes a fixing unit 25 and the toner image carried on the recording sheet 20 is heated and fixed thereon.

If a target print is a single-side print, the recording sheet 20 is directly conveyed to a sheet discharge tray 26. If the target print is a duplex print, a conveyance direction of the recording sheet 20 is reversed and the recording sheet 20 is conveyed to a sheet reversing section. Upon the recording sheet 20 reaching the sheet reversing section, the recording sheet 20 is reversed by a switchback roller pair 27 and comes out of the sheet reversing section with its trailing end of the recording sheet 20 at the head. This is called a switchback operation, by which operation the recording sheet 20 is reversed upside down. The recording sheet 20 which is reversed does not return to the fixing unit 25, passes a refeed conveyance path, and joins the regular sheet conveyance path. Thereafter, the toner image is transferred onto the recording sheet 20 as in the case of the single-side print, and the recording sheet 20 passes the fixing unit 25 and is discharged outside. This is the duplex print operation.

Thereafter, the residual toner is removed from the surface of the photoreceptor by photoreceptor cleaning units 7Y, 7M, 7C, and 7K, respectively. Then, the surface of each of the photoreceptor drums 2Y, 2M, 2C, and 2K is discharged uniformly by the neutralizing lamps 8Y, 8M, 8C, and 8K, respectively so that each of the photoreceptor drums 2Y, 2M, 2C, and 2K becomes ready to be charged for a next image formation. The intermediate transfer belt 1 that has passed the secondary transfer nip N2 carries residual toner after secondary transfer on a surface thereof. The residual toner after secondary transfer on the intermediate transfer belt 1 is also removed by the belt cleaning unit 15 and the intermediate transfer belt 1 becomes ready for a next image formation. By repeating such operations, the single-side print or the duplex print can be performed.

The image forming apparatus 100A includes an image density sensor 30 to detect an image density or a toner deposition amount per unit area of a toner image formed on the outer circumferential surface of the intermediate transfer belt 1. The image density sensor 30 is an optical sensor formed of optical elements. Readings from the image density sensor 30 is used for correcting the image forming condition setting data to reduce the image density fluctuation (i.e., the image density fluctuation in the sub-scanning direction).

In the embodiment as illustrated in FIG. 1, the image density sensor 30 is disposed at a position P1 before the secondary transfer which is opposed to a part of the intermediate transfer belt 1 wound around a roller 11. Alternatively, the image density sensor 30 may be positioned at a position P2 after the secondary transfer which is downstream of the nip N2 as in FIG. 1. When the image density sensor 30 is positioned at the position P2 downstream of the secondary transfer nip N2, it is preferred that a roller 14 configured to stop fluctuation of the intermediate transfer belt 1 be disposed on an internal surface of the intermediate transfer belt 1 to be opposed to the image density sensor 30.

Among two positions of the image density sensor 30, the position P1 before the secondary transfer coincides with a position to detect the toner pattern on the intermediate transfer belt 1 before the secondary transfer process. If there are no particular limitations on layout, the image density sensor 30 is usually mounted at the position P1. In addition, the position P1 before the secondary transfer is the position where the toner pattern for correction to be used for detecting image density fluctuation can be detected immediately after the formation, and therefore, no need of waiting. Further, the toner pattern for correction does not need to pass through the secondary transfer nip N2, thereby not necessitating a scheme for that.

However, because there are many image forming apparatuses employing a configuration in which a secondary transfer position such as the secondary transfer nip N2 is disposed immediately after the fourth-color image forming station (see, for example, the black station in FIG. 1), in such a case, installing the image density sensor 30 at the position P1 is difficult due to the limited space. In such a case, the image density sensor 30 is disposed at the position P2, which is after the secondary transfer, the image pattern toner image formed on the intermediate transfer belt 1 is passed through the secondary transfer nip N2, and the image density sensor 30 is to detect the density of the toner image. How to pass through the secondary transfer nip N2 includes two ways: one is to separate the secondary transfer roller 16 from the intermediate transfer belt 1; and another is to apply reverse bias to the secondary transfer roller 16. However, it is not limited in the present embodiment.

Herein, another image forming apparatus with a different structure from the structure illustrated in FIG. 1 will be described.

Figure 2:
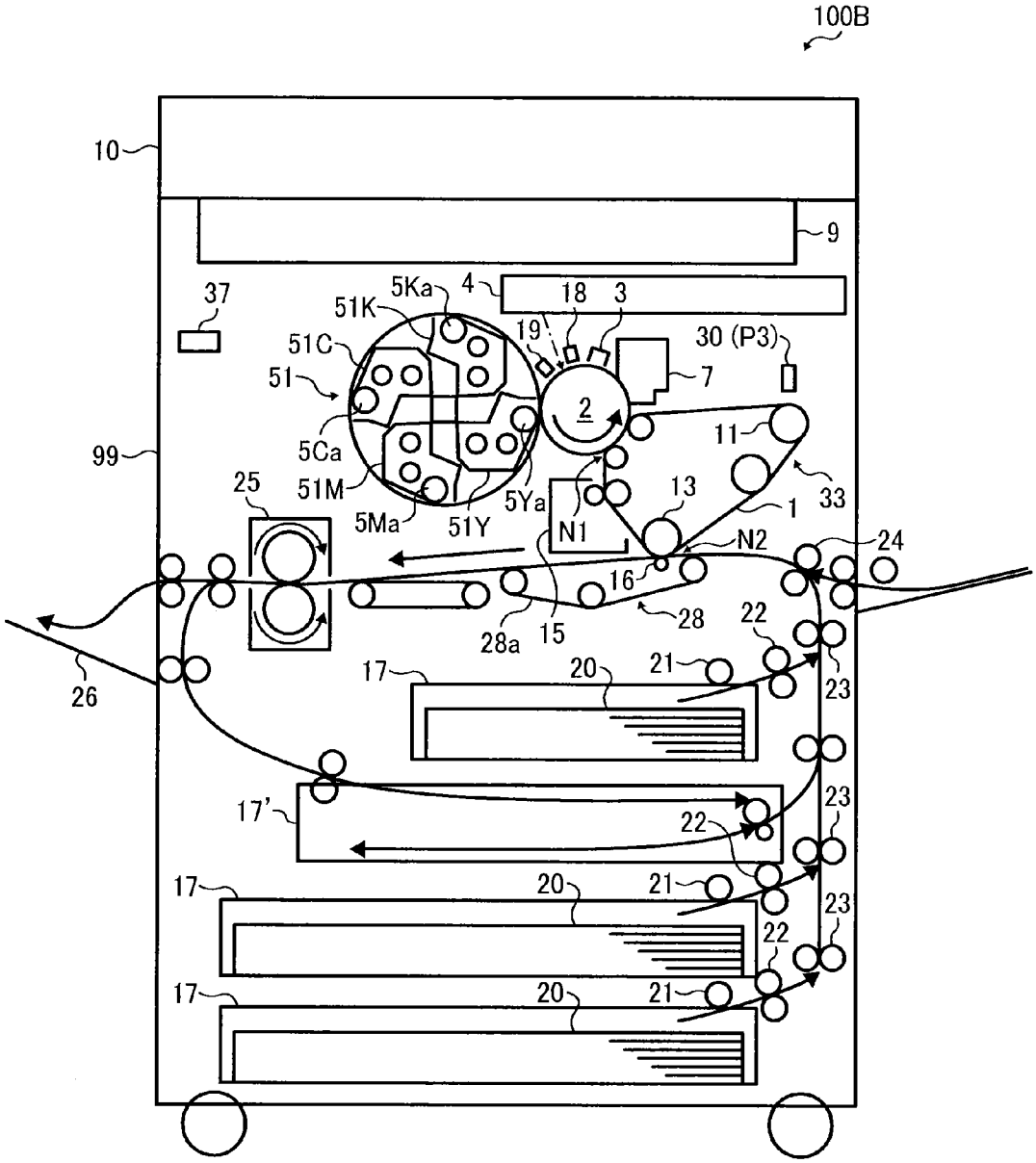
FIG. 2 illustrates a schematic configuration of another image forming apparatus according to another embodiment of the present invention.

FIG. 2 illustrates a schematic view of an image forming apparatus to which the present invention may be applied.

In FIG. 2, any part or device which is similar to the part or device included in the image forming apparatus 100A as illustrated in FIG. 1 will be applied the same reference numeral, and a redundant description thereof will be omitted. An image forming apparatus 100B as illustrated in FIG. 2 is a full-color copier employing one-drum type intermediate transfer method, including a photoreceptor drum 2 as a drum-shaped image carrier and a revolver development unit 51 disposed opposing to the photoreceptor drum 2. The revolver development unit 51 includes four developing devices 51Y, 51M, 51C, and 51K, each as a developing unit, which are held in a holding body rotating about a rotary shaft. The developing devices 51Y, 51M, 51C, and 51K each develop electrostatic latent image on the photoreceptor drum 2 by supplying color toner of yellow (Y), magenta (M), cyan (C), and black (K).

When the holding body of the revolver development unit 51 is rotated, an arbitrary developing device among the developing devices 51Y, 51M, 51C, and 51K is moved to a developing position opposed to the photoreceptor drum 2, so that the electrostatic latent image on the photoreceptor drum 2 is developed in a color coincident to the color of the arbitrary developing device. When a full-color image is to be formed, for example, each electrostatic latent image for Y-, M-, C-, and K-color is sequentially formed on the photoreceptor drum 2 while the endless intermediate transfer belt 1 is being rotated substantially four revolutions and the electrostatic latent images on the photoreceptor drum 2 are sequentially developed by the developing devices 51Y, 51M, 51C, and 51K for the colors of Y, M, C, and K. Then, the toner images of the colors of Y, M, C, and K formed on the photoreceptor drum 2 are sequentially superimposed on the intermediate transfer belt 1 in the primary transfer nip N1.

The secondary transfer nip N2 in which a roller 13, a support member of the intermediate transfer belt 1, and the secondary transfer roller 16 of the secondary transfer unit 28 are opposed each other is the secondary transfer nip in which the intermediate transfer belt 1 and a transfer conveyance belt 28*a* of the secondary transfer unit 28 contact each other with a predetermined nip width. When the 4-color superimposed toner image on the intermediate transfer belt 1 as described above passes the secondary transfer nip N2, the 4-color superimposed toner image on the intermediate transfer belt 1 is transferred en bloc onto the recording sheet 20 which has been conveyed by a transfer conveyance belt 28*a* of the secondary transfer unit 28 at an appropriately timing in sync with the passing of the 4-color superimposed toner image.

When images are to be formed on both sides of the recording sheet 20, the recording sheet 20 which has passed the fixing unit 25 is conveyed to a duplex print unit 17', the recording sheet 20 which is reversed by the duplex print unit 17' is re-fed to the secondary transfer nip N2, and the 4-color superimposed toner image on the intermediate transfer belt 1 is transferred en block on the reversed surface thereof as a secondary transfer. In the image forming apparatus 100B as illustrated in FIG. 2, the image density sensor 30 is disposed at a position P3 before the secondary transfer which is a position opposed to the part of the intermediate transfer belt 1 wound around the roller 11.

Figure 3:
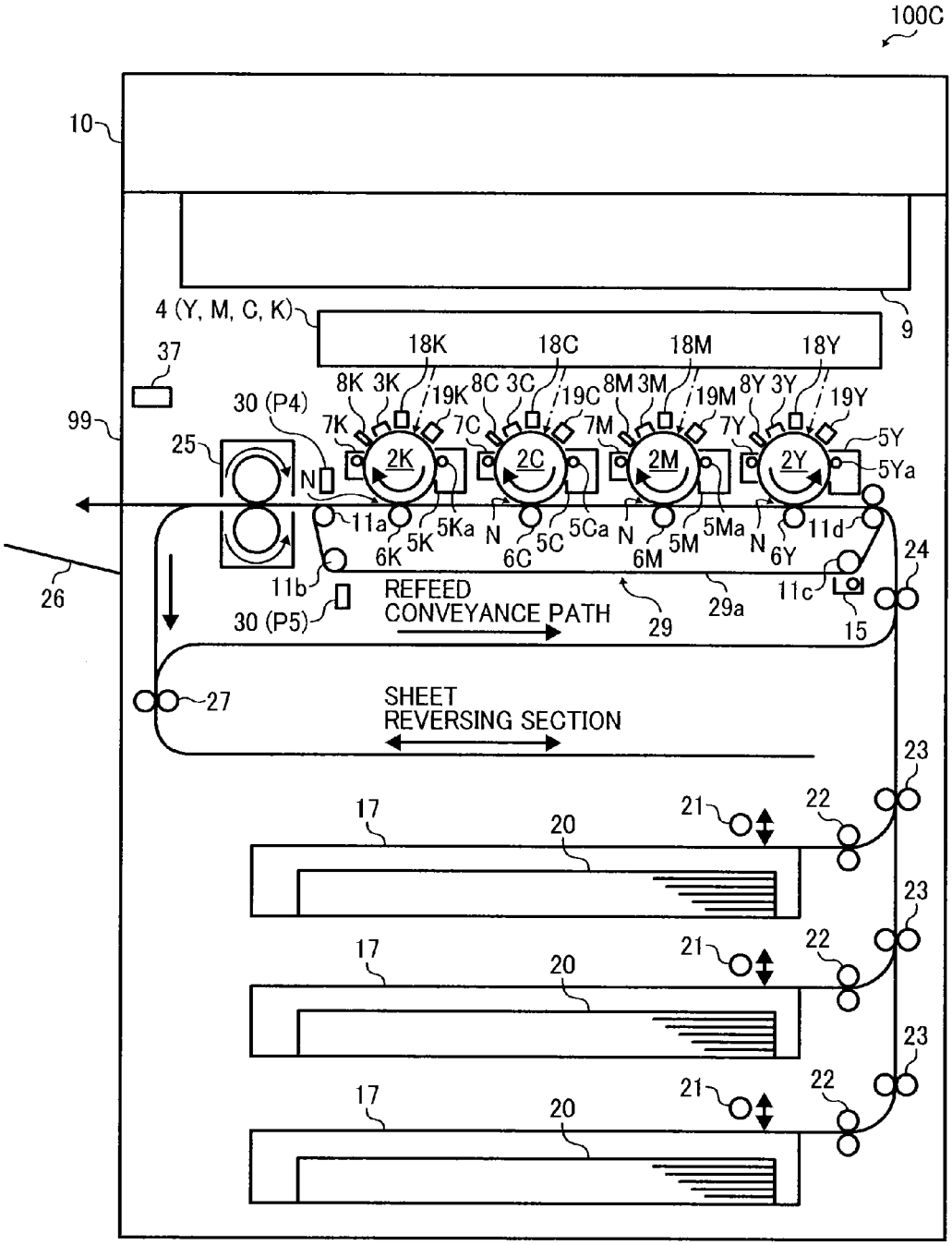
FIG. 3 illustrates a schematic configuration of yet another image forming apparatus according to yet another embodiment of the present invention.

FIG. 3 shows a schematic view of an image forming apparatus illustrating a yet another embodiment of the present invention.

In FIG. 3, any part or device which is similar to the part or device included in the image forming apparatus 100A as illustrated in FIG. 1 will be applied the same reference numeral, and a redundant description thereof will be omitted.

An image forming apparatus 100C as illustrated in FIG. 3 represents a full-color copier employing 4-storied tandem direct transfer method, including a transfer unit 29 disposed below four sets of image forming stations and configured to transfer a toner image formed on the photoreceptor drums 2Y, 2M, 2C, and 2K onto the recording sheet 20. The transfer unit 29 includes an endless transfer belt 29*a* rotatably supported by rollers 11*a* to 11*d*, a plurality of support members. Specifically, the transfer belt 29*a* is wound around a drive roller 11*a* and driven rollers 11*b* to 11*d*, is driven to rotate anticlockwise at a predetermined timing, and passes transfer positions N of each of the image forming stations while carrying the recording sheet 20 thereon. Transfer rollers 6Y, 6M, 6C, and 6K disposed on an interior surface of the transfer belt 29*a* each transfer a toner image formed on each photoreceptor drum 2Y, 2M, 2C, or 2K at each transfer position N onto the recording sheet 20 by applying transfer electric potential.

In the image forming apparatus 100C as illustrated in FIG. 3, when a full-color mode in which 4-color superimposed image is to be formed is selected on a control panel, not shown, an image formation process in which a toner image of each color of Y, M, C, or K is formed on each of the photoreceptor drums 2Y, 2M, 2C, and 2K, that is, image forming stations of each color, is performed in sync with a conveyance of the recording sheet 20. Meanwhile, the recording sheet 20 fed out from the paper tray 17 is sent out by the registration roller pair 24 at a predetermined timing, is carried by the transfer belt 29*a*, and is conveyed to pass the transfer position N of each image forming station. The recording sheet 20 onto which a full-color toner image has been transferred and a 4-color superimposed toner image is formed thereon is subjected to fixation by the fixing unit 25. The recording sheet 20 is then discharged onto the sheet discharge tray 26.

In the image forming apparatus 100C as illustrated in FIG. 3, the image density sensor 30 is disposed at a position P4, before the fixation, which is a position most downstream of the transfer unit 29 in the recording sheet conveyance direction and opposed to the part of the intermediate transfer belt 29*a* wound around the roller 11*a*.

In each of the image forming apparatuses 100A, 100B, and 100C, as illustrated in FIGS. 1 to 3, respectively, because the toner pattern for correction is formed on the photoreceptor drums 2Y, 2M, 2C, and 2K or the photoreceptor drum 2 and is transferred to the intermediate transfer belt 1 or the transfer belt 28*a* or 29*a*, the image density sensor 30 can be so disposed as to oppose to each of the photoreceptor drums 2Y, 2M, 2C, and 2K or the surface of the photoreceptor drum 2. The mounting position of the image density sensor 30 in this case is between the developing position by the developing units 5Y, 5M, 5C, and 5K or the revolver development unit 51 and the primary transfer nip or the transfer position N as a transfer position to the intermediate transfer belt 1 or the transfer conveyance belt 28*a* or 29*a*.

Next, how to correct the image forming condition setting data to reduce the image density fluctuation in the image forming apparatus 100A according to embodiments of the present invention will be described.

In the correction control of the image density fluctuation, a toner pattern for correction is formed, the image density of the formed toner pattern for correction is detected, and the image density fluctuation is reduced, thereby improving the quality of the formed image. In the description below, a case applying to the image forming apparatus 100A will be described, which can be similarly applied to the image forming apparatuses 100B and 100C.

Figure 4:
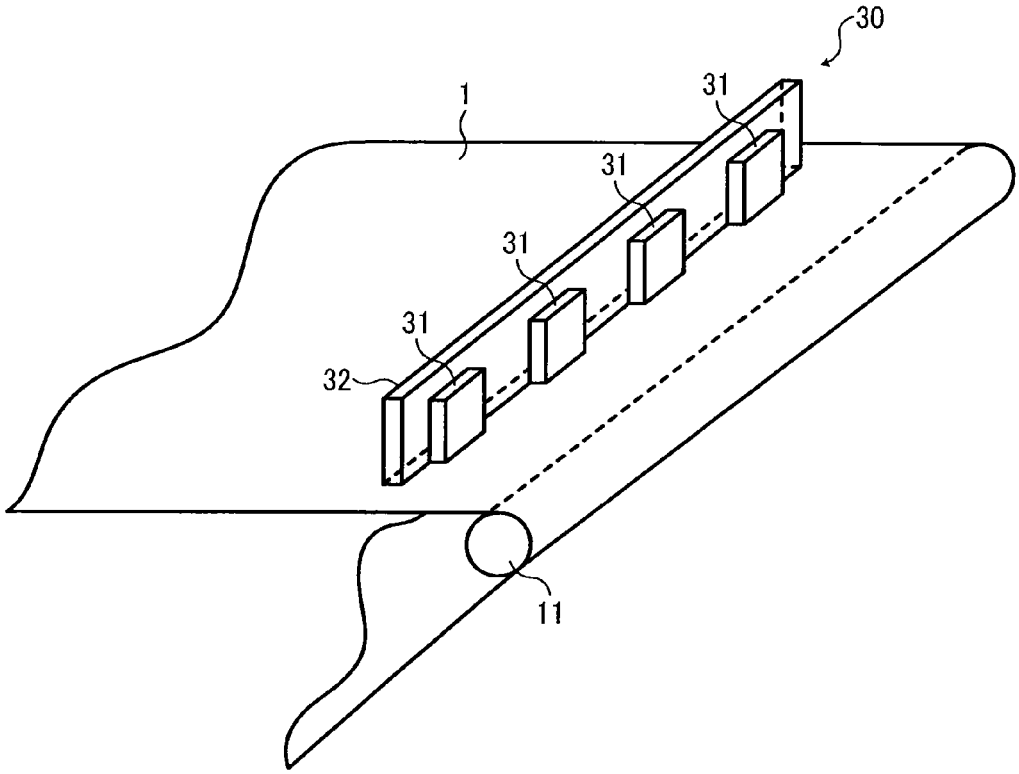
FIG. 4 is a partial perspective view of an image density sensor illustrating an example of installing the sensor.

FIG. 4 is a partial perspective vie illustrating an example of the image density sensor 30.

More specifically, FIG. 4 shows an example of the image density sensor 30 in a configuration in which it is disposed at the position P1 before the secondary transfer in the image forming apparatus 100A. The toner image sensor 30 includes a sensor substrate 32 and four sensor heads 31 as optical sensors to detect a density of an image, that is, a four-head type image density sensor 30. Accordingly, each sensor head 31 is disposed along a main scanning direction perpendicular to the rotation direction of the intermediate belt (i.e., the sub-scanning direction). Put differently, the four sensor heads 31 are disposed along a shaft direction of the photoreceptor drums 2Y, 2M, 2C, and 2K.

With such a configuration, a toner deposition amount at four positions in the main scanning direction can be measured simultaneously, so that one sensor head 31 can be used exclusively for one color. It is to be noted that the number of sensor heads is not limited to only four and therefore the image density sensor 30 may be configured to include one to three sensor heads or five or more sensor heads.

Each sensor head 31 is disposed opposite the intermediate transfer belt 1, as a detection target, across an interval of some 5 mm to the outer circumferential surface of the intermediate transfer belt 1. In the present embodiment, the image density sensor 30 is disposed in the vicinity of the intermediate transfer belt 1 and the image formation condition setting data is corrected based on the toner deposition amount on the intermediate transfer belt 1 and image forming timing is determined based on the toner deposition position on the intermediate transfer belt 1. However, the image density sensor 30 may be disposed opposite the photoreceptor drums 2Y, 2M, 2C, and 2K, or opposite the transfer conveyance belt 28*a* as illustrated in FIG. 2 to oppose to the recording sheet 20 on which the toner image is transferred from the intermediate transfer belt 1.

Output signals from the image density sensor 30 are converted into a toner deposition amount via a well-known deposition amount conversion algorithm stored in the controller 37, for storage in the nonvolatile memory or volatile memory included in the controller 37 as an image density. In this respect, the controller 37 together with the image density sensor 30 implement an image density detection unit. The controller 37 stores the image density as chronological data at predetermined sampling intervals. The nonvolatile or volatile memory included in the controller 37 further stores various data including output data, data for correction, controlling results of each sensor such as surface potential sensors 19Y, 19M, 19C, and 19K.

Figure 5A:
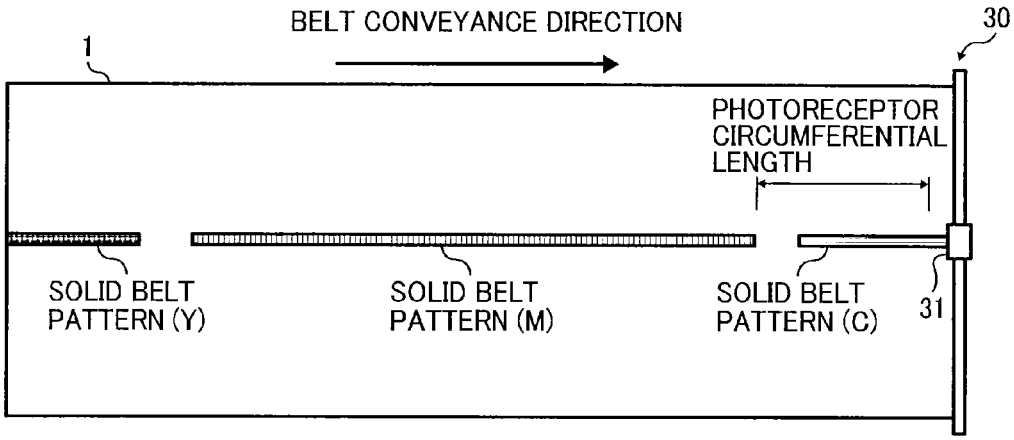
FIG. 5A is an explanatory view illustrating an example of toner patterns for correction in which each color toner pattern is formed at the same position in a main scanning direction.
Figure 5B:
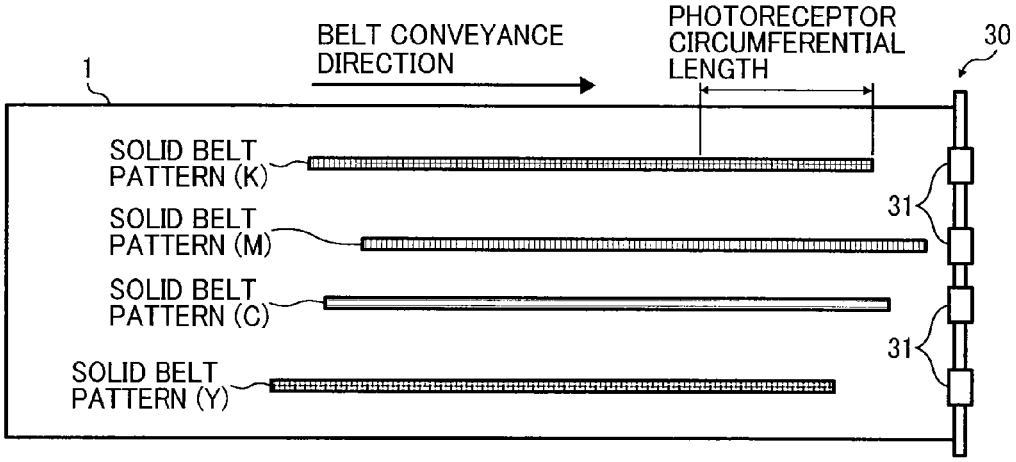
FIG. 5B is an explanatory view illustrating an example of toner patterns for correction in which each color toner pattern is formed at different positions in the main scanning direction.

As illustrated in FIGS. 5A and 5B, the pattern image for correction is formed as a shadow portion with a high image density in the present embodiment for each color of yellow, magenta, cyan, and black, because the image density fluctuation can be detected more accurately when the toner pattern for correction has a higher density. As a toner pattern for correction, a solid image, or a toner image with a maximum density is used. The toner pattern for correction in the present embodiment is represented by a solid image; however, as long as the image density fluctuation can be detected, a less dense image can be used.

The toner pattern for correction is formed in a long belt pattern along a sub-scanning direction along the rotation direction of the intermediate transfer belt 1. A length of the toner pattern for correction in the sub-scanning direction is at least one circumferential length of a rotary member (i.e., the photoreceptor drums 2Y, 2M, 2C, and 2K or the developing rollers 5Ya, 5Ma, 5Ca, and 5Ka) having the same or one n-th (where n is an integer) rotary cycle of the image density fluctuation. In the present embodiment, the length is three times the circumference of the photoreceptor drum 2Y, 2M, 2C, or 2K.

In the present embodiment, a correction control is to be performed to suppress the image density fluctuation caused by the periodical fluctuation of a development gap between the photoreceptor drum 2Y, 2M, 2C, or 2K and the developing roller 5Ya, 5Ma, 5Ca, or 5Ka. More specifically, the eccentric rotation of the photoreceptor drum 2Y, 2M, 2C, or 2K is raised as a cause of the fluctuation factors of the development gap. The eccentric rotation is caused by, for example, eccentricity of the rotary center position of the photoreceptor drums 2Y, 2M, 2C, and 2K. Accordingly, the image density fluctuation based on the fluctuation of the development gap includes an image density fluctuation component including a rotation cycle of each of the photoreceptor drums 2Y, 2M, 2C, and 2K. The rotation cycle includes one rotation cycle divided by an integral number. In order to detect the image density fluctuation component, a length corresponding to at least one circumferential length of each of the photoreceptor drums 2Y, 2M, 2C, and 2K is required as a length of the toner pattern for correction in the sub-scanning direction.

FIG. 5A illustrates an example of toner patterns for correction, in which each color toner pattern is formed at the same position in the main scanning direction. Each position coincides with the detection area by the image density sensor 30 in the main scanning direction, that is, the position at which the sensor head 31 is disposed. In the example as illustrated in FIG. 5A, the position of the toner pattern for correction in the main scanning direction is a center of the intermediate transfer belt 1; however, the position is not limited to this. For example, the toner pattern for correction may be disposed at an end in the main scanning direction. On the other hand, FIG. 5B illustrates an example of the toner patterns for correction, in which each color toner pattern is formed at a different position in the main scanning direction. Each position corresponds to a detection area of the image density sensor 30 in the main scanning direction, that is, the position at which each sensor head 31 is disposed.

If the toner pattern for correction is formed as illustrated in FIG. 5A, the number of the sensor head 31 to detect the image density of each toner pattern is only one, which is an advantage. On the other hand, if the toner pattern for correction is formed as illustrated in FIG. 5B, each toner pattern can be detected simultaneously, so that the time taken to complete detection of the image density is short, which is also an advantage.

As described heretofore, the image density sensor 30 is provided for each of the photoreceptor drums 2Y, 2M, 2C, and 2K to detect the density of the image formed on the photoreceptor drums 2Y, 2M, 2C, and 2K, respectively. With this structure, the effect of the fluctuation in the movement of the intermediate transfer belt 1 can be prevented. Further, the image density sensor 30 may be disposed opposite the recording sheet 20 on which the toner image is transferred from the intermediate transfer belt 1 so that the image density sensor 30 can detect the density of the image formed on the recording sheet 20. With this configuration, the effect of the fluctuation in the move of the recording sheet 20 can be prevented.

Image forming conditions to form the toner pattern for correction are kept constant. Examples of image forming conditions include, for example, charging conditions by the chargers 3Y, 3M, 3C, and 3K, exposure conditions or writing conditions of the optical write units 4Y, 4M, 4C, and 4K, developing conditions of the developing units 5Y, 5M, 5C, and 5K, and transfer conditions of the primary transfer rollers 6Y, 6M, 6C, and 6K. As a charging condition, a charging bias is included; as a writing condition, strength of the writing beam is included; as a developing condition, a developing bias is included; and as a transfer condition, a transfer bias is included. Herein, the chargers 3Y, 3M, 3C, and 3K, the optical write units 4Y, 4M, 4C, and 4K, the developing units 5Y, 5M, 5C, and 5K, and the primary transfer rollers 6Y, 6M, 6C, and 6K each perform a series of normal image forming processes of an electrophotographic image forming apparatus including development, charging, exposure, and the like, in forming toner patterns for correction.

Without fluctuations in the development gap and other factors causing the image density fluctuation such as the sensitivity fluctuation of the photoreceptor drums 2Y, 2M, 2C, and 2K, if the toner pattern for correction formed of the solid image is formed while keeping the image forming conditions constant, the density of the formed image is uniform in the sub-scanning direction and no image density fluctuation occurs. However, even though the toner pattern for correction formed of the solid image is formed while keeping the image forming conditions constant, the image density fluctuation occurs due to other factors causing the image density fluctuation such as the fluctuation in the development gap. The image density fluctuation can be detected by the image density sensor 30 that repeatedly detects the image density of the toner pattern for correction as a belt-shaped pattern of a long solid image in the sub-scanning direction. Specifically, an output signal of the image density sensor 30 is input to the controller 37 so that the controller 37 stores the input data as an image density in the chronological order with reference to a home position of each of the photoreceptor drum 2Y, 2M, 2C, and 2K, based on the rotary position detection signal from each of the photointerrupter 18Y, 18C, 18C, and 18K.

Figure 6:
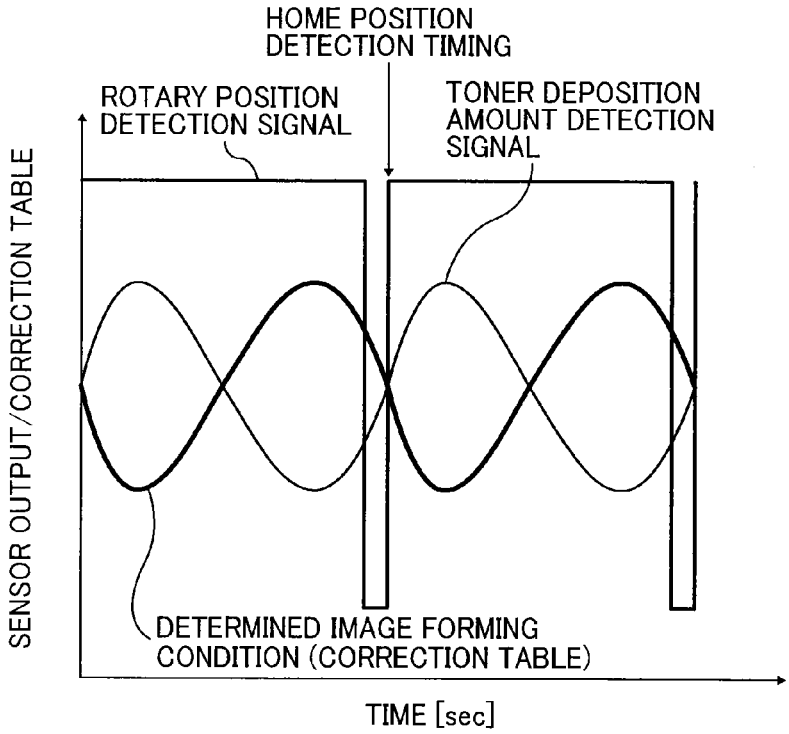
FIG. 6 shows a relation between a rotary position detection signal output from photointerrupters and a toner deposition amount detection signal, that is, a photoreceptor drum rotary cycle component detected by an image density sensor, and a correction table generated based on the above signals.

FIG. 6 shows a relation between a rotary position detection signal output from the photointerrupters 18Y, 18M, 18C, and 18K and a toner deposition amount detection signal, that is, a photoreceptor drum rotary cycle component detected by the image density sensor 30, on the one hand, and a correction table (or a correction data) generated based on the above signals on the other. FIG. 6 shows signals of two cycles of the photoreceptor drums 2Y, 2M, 2C, and 2K.

The density fluctuation of the toner pattern for correction is represented as fluctuation in the sensor output of the toner deposition amount detection signal in FIG. 6. The toner deposition amount detection signal changes at the same cycle with a cycle of the rotary position detection signal. In the present embodiment, the image forming condition setting data of the developing unit 5Y, 5M, 5C, and 5K and the charger 3Y, 3M, 3C, and 3K is corrected to generate the image density fluctuation which is opposite in the phase of the image density fluctuation so that the correction table to cancel the image density fluctuation is created.

Herein, there is a case in which the expression "opposite phase" is not appropriate because the development bias, the exposure power, or the charging bias which are used as the image forming condition setting data, may include a – (minus) sign or may cause a reduced deposition amount with a high absolute value. However, the expression "opposite phase" is used to mean a correction table to cancel the image density fluctuation as represented by the toner deposition amount detection signal, that is, a correction table to create the image density fluctuation having a phase opposite that the image density fluctuation represented by the toner deposition amount detection signal is to be created.

A gain is a fluctuation amount of the correction table in determining the correction table with respect to the fluctuation amount [V] of the toner deposition amount detection signal. The gain can be principally obtained by theory, but is verified in an actual experiment based on the theoretical value and is obtained finally from the experimental data.

Using the gain determined as above, when the correction table to cause the image density fluctuation with the opposite phase is to be generated from the toner deposition amount detection signal, the correction table is generated based on the rotary position detection signal output from the photointerrupters 18Y, 18M, 18C, and 18K referring to the timing as illustrated in FIG. 6. In the example illustrated in FIG. 6, the correction table is generated such that the lead of the correction table is in synchronization with the home position detection timing, i.e., a rise of the rotary position detection signal.

When, for example, the correction table for correcting the developing bias is to be created, it is necessary to consider the moving time of the toner pattern for correction from the developing area to the image density sensor 30. If such moving time is just an integer multiple of the circumferential length of the photoreceptor, the lead of the correction table may be set to coincide with the timing of the rotary position detection signal. If the moving time is not an integer multiple of the circumferential length of the photoreceptor and is delayed, the correction table can be generated by shifting a time period by the delayed time. Similarly, when generating the correction table for the exposure power, the correction table may be applied considering the toner pattern moving time from the exposure position to the image density sensor 30. Similarly, when generating the correction table for the charging bias, the correction table may be applied considering the toner pattern moving time from the charging position to the image density sensor 30. In actuality, a phase error may be caused due to the delay of the output responsiveness of the high-voltage power supply, component tolerances, and errors in the layout distance due to assembly tolerances. Accordingly, it is preferred that the correction table be generated first by experiments using the actual machine based on the theoretical values and finally adjusting phase errors in view of experimental results.

Timing to start forming the toner pattern for correction is determined based on the timing at which the home position of the photoreceptor drums 2Y, 2M, 2C, and 2K are detected by the photointerrupters 18Y, 18M, 18C, and 18K. In the example illustrated in FIG. 6, the toner pattern for correction is formed in synchronization with the home position detection timing such that the leading position of the toner pattern for correction is detected by the image density sensor 30 at a home position detection timing, i.e., at a rise of the rotary position detection signal.

In order to generate the toner pattern for correction at the timing as described above, as illustrated in FIG. 7, a rotary position detection signal from the photo interrupters 18Y, 18M, 18C, and 18K, respectively, is input to the controller 37.

The controller 37 obtains the home position detection timing from the inputted rotary position detection signal, controls the image forming unit in sync with the timing, and forms the toner pattern for correction.

Figure 7:
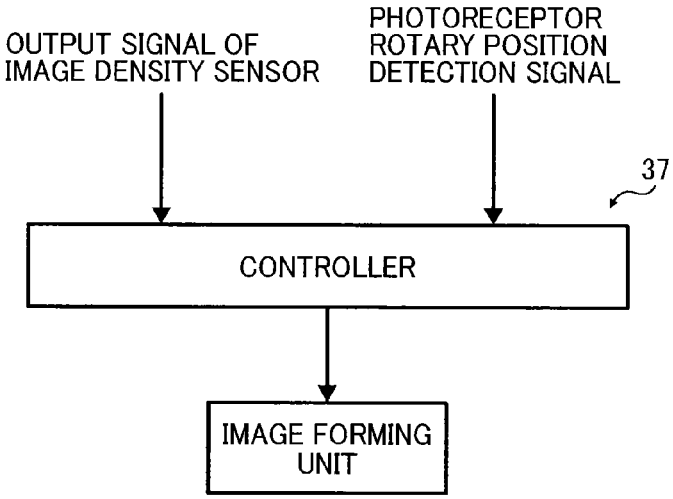
FIG. 7 is an explanatory view showing input data and output data of a controller.

In addition, as illustrated in FIG. 7, an output signal (i.e., a toner deposition amount detection signal) from the image density sensor 30 is input to the controller 37. When generating the correction table, the controller 37 obtains the home position detection timing from the inputted rotary position detection signal from the photo interrupters 18Y, 18M, 18C, and 18K, starts sampling the toner deposition amount detection signal from the image density sensor 30 in sync with the timing, and forms the toner pattern for correction.

Figure 8:
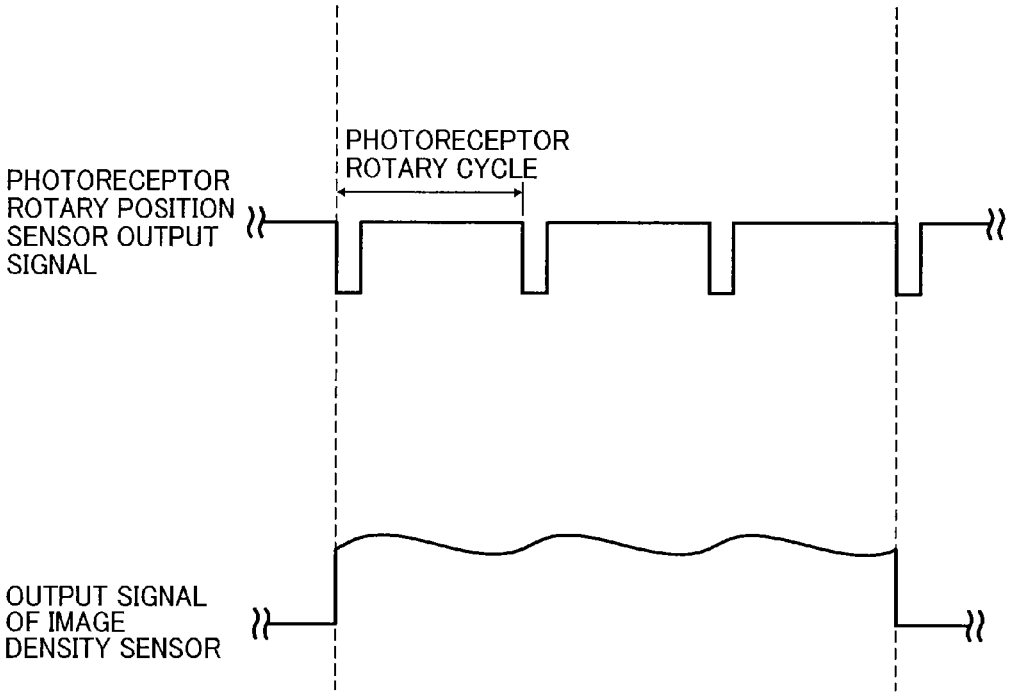
FIG. 8 is a timing chart illustrating a relation between a rotary position detection signal of the photoreceptor drum inputted into the controller and an output signal, that is, a toner deposition amount detection signal of the image density sensor.

FIG. 8 is a timing chart illustrating a relation between a rotary position detection signal of the photoreceptor drum inputted into the controller 37 and an output signal, i.e., the toner deposition amount detection signal of the image density sensor 30.

In the present embodiment, in order to obtain the opposite phase as illustrated in FIG. 6, the exposure start position of the toner pattern for correction is determined to be in sync with the home position detection timing, such that the leading position of the toner pattern for correction is detected by the image density sensor 30 at the home position detection timing, i.e., at the rise of the rotary position detection signal. In the present embodiment, sampling of the toner deposition amount detection signal from the image density sensor 30 is started from the head position of the toner pattern for correction. In such a case, the toner deposition amount near the leading portion of the toner pattern for correction tends to be unstable. As a result, the exposure start position of the toner pattern for correction by the optical write unit 4Y, 4M, 4C, and 4K may be determined such that the sampling of the toner deposition amount detection signal from the image density sensor 30 is started from a position shifted in the trailing end side in which the toner deposition amount is stabilized, not at the head position of the toner pattern for correction.

In determining the exposure start position of the toner pattern for correction, data related to the home position detection timing of the photoreceptor drums 2Y, 2M, 2C, and 2K detected by the photointerrupters 18Y, 18M, 18C, and 18K and a time period in which the toner pattern for correction shifts from the exposure position by the optical write unit 4Y, 4M, 4C, and 4K to the detection position by the image density sensor 30 are required. Those data are stored in the nonvolatile memory or the volatile memory included in the controller 37. The exposure start position of the toner pattern for correction is determined responsive to all those data. The time period in which the toner pattern for correction shifts from the exposure position by the optical write unit 4Y, 4M, 4C, and 4K to the detection position by the image density sensor 30 can be calculated from the layout distance between the exposure position by the optical write unit 4Y, 4M, 4C, and 4K to the detection position by the image density sensor 30, and a process linear speed.

The trailing end position of the toner pattern for correction may also be determined similarly to the head position as determined above. Alternatively, the trailing end position can also be determined responsive to the above data even in a case where the head position is arbitrarily determined. Specifically, the determination of the head position and/or the trailing end position responsive to the data may be performed based on the elapsed time period from when the home position detection of the photoreceptor drums 2Y, 2M, 2C, and 2 has been detected by the photointerrupters 18Y, 18M, 18C, and 18K. Even in this case, the determination of the head position or the trailing end position is performed substantially based on the above data. Further optionally, while the write start of the toner pattern for correction may be performed arbitrarily, the exposure end position may be determined to be an integral multiple of the circumferential length of the photoreceptor drums 2Y, 2M, 2C, and 2K. The elapsed time period can be measured for example by the CPU of the controller 37. In the measurement, the controller 37 functions as an elapsed time period measuring unit.

By controlling the timing to form the toner pattern for correction, an unnecessarily long toner pattern for correction need not be prepared, thereby improving the toner yield and reducing the control time. In addition, the interval when the toner pattern for correction shifts to the detection position by the image density sensor 30 varies from color to color so that the exposure start position of the toner pattern for correction is appropriately adjusted for each image forming station, but the toner pattern for correction for each color may be different from each other in the sub-scanning direction as illustrated in FIG. 5B.

In the above description, a case in which the development gap varies due to the eccentric rotation of the photoreceptor drums 2Y, 2M, 2C, and 2K has been described; however, the fluctuation of the development gap also occurs due to the eccentric rotation of the developing rollers 5Ya, 5Ma, 5Ca, and 5Ka. As a result, together with the photoreceptor drums 2Y, 2M, 2C, and 2K, or instead the same, similarly to the case of photoreceptor drums 2Y, 2M, 2C, and 2K, a correction table to reduce the image density fluctuation component having a rotary cycle of the developing rollers 5Ya, 5Ma, 5Ca, and 5Ka may be generated by detecting a reference rotary position (i.e., a home position) of the developing rollers 5Ya, 5Ma, 5Ca, and 5Ka by the reference rotary position sensor, and by synchronizing the detected home position.

Figure 9:
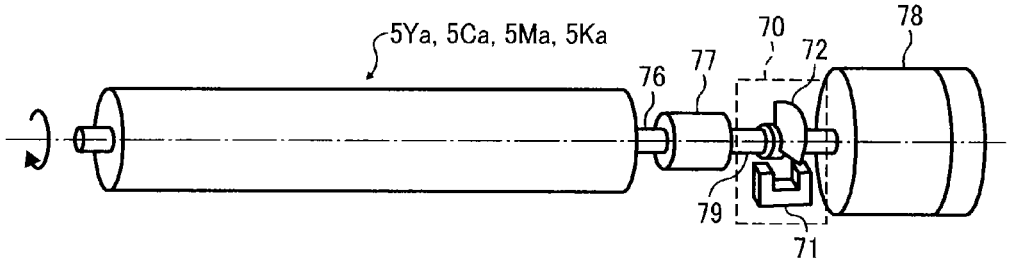
FIG. 9 schematically illustrates a developer rotation position detector including a photointerrupter to detect a home position of the developing roller.

FIG. 9 schematically illustrates a developer rotation position detector 70 including a photointerrupter 71 serving as a reference rotary position sensor to detect a home position of the developing rollers 5Ya, 5Ma, 5Ca, and 5Ka.

One developer rotation position detector 70 is provided individually to each of the developing rollers 5Ya, 5Ma, 5Ca, and 5Ka. Further, as illustrated in FIG. 9, each of the developing rollers 5Ya, 5Ma, 5Ca, and 5Ka is disposed on a rotary center axis 76 connected to an axis 79 being a motor output axis of a drive motor 78, via a coupling 77. Therefore, the developer rotation position detector 70 is driven to rotate by the drive of the drive motor 78.

The rotation position detector 70 further includes a shield member 72 continuous with the axis 79 and rotates with the rotation of the axis 79. The shield member 72 is detected by the photointerrupter 71 when the developing rollers 5Ya, 5Ma, 5Ca, and 5Ka each assume a predetermined position as they rotate. Thus, the photointerrupter 71 detects a reference rotary position of each of the developing rollers 5Ya, 5Ma, 5Ca, and 5Ka.

In FIG. 9, the developing rollers 5Ya, 5Ma, 5Ca, and 5Ka are driven by a direct drive method directly connecting to the drive motor, but a speed reducer may be included in the drive transmission from the drive motor 78. When the speed reducer is adopted, the shield member 72 is preferably mounted on the axis 76 so that the shield member 72 and each of the developing rollers 5Ya, 5Ma, 5Ca, and 5Ka are set to have the same rotation speed. The same is applied to a case in which the rotation position of the photoreceptor drums 2Y, 2M, 2C, and 2K is detected.

Figure 10:
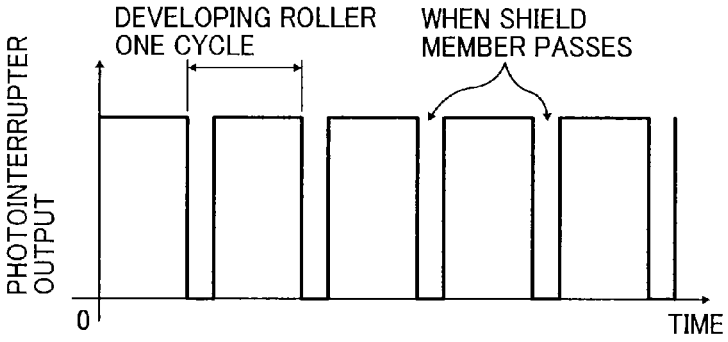
FIG. 10 shows an example of an output signal from the photointerrupter.

FIG. 10 shows an example of an output signal from the photointerrupter 71. It can be seen It can be seen that the output is decreased to substantially zero when the shield member 72 rotating in sync with the developing rollers 5Ya, 5Ma, 5Ca, and 5Ka interrupts a light path from the photointerrupter 71. By using the zero edge, the home position of the developing rollers 5Ya, 5Ma, 5Ca, and 5Ka may be detected. When generating the correction table to reduce the image density fluctuation component having the rotary cycle of the developing rollers 5Ya, 5Ma, 5Ca, and 5Ka, the controller 37 samples the toner deposition amount detection signal of the toner pattern for correction in sync with the home position of the developing rollers 5Ya, 5Ma, 5Ca, and 5Ka, based on the output signal of the developing roller rotary position detection signal from the photo interrupter 71.

Figure 11:
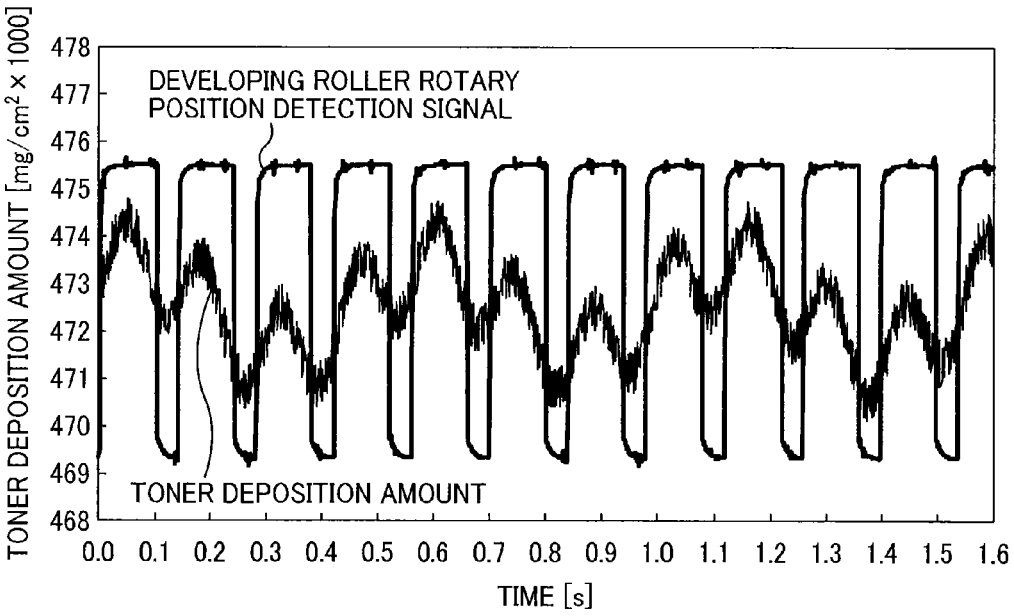
FIG. 11 shows a relation between variations in the toner deposition amount based on the toner deposition amount detection signal from the image density sensor and an output signal, that is, a developing roller rotary position detection signal from the photointerrupter.

FIG. 11 is a graph that shows a relation between variations in the toner deposition amount based on the toner deposition amount detection signal from the image density sensor 30 and an output signal, that is, a developing roller rotary position detection signal from the photointerrupter 71. The horizontal axis of the graph represents time in seconds and the vertical axis represents a toner deposition amount [$mg/cm^2 \times 1000$], which is obtained from the toner deposition amount detection signal detected by the image density sensor 30 converted into the toner deposition amount using the deposition amount conversion algorithm. As observed in FIG. 11, it can be seen that the toner deposition amount detection signal obtained by the image density sensor 30 from the toner pattern for correction includes cyclic fluctuations corresponding to the rotary cycle of the developing rollers 5Ya, 5Ma, 5Ca, and 5Ka.

As observed in FIG. 11, it can be seen that the toner deposition amount detection signal from the image density sensor 30 includes cyclic components of the developing rollers 5Ya, 5Ma, 5Ca, and 5Ka as well as cyclic components of, for example, the photoreceptor drums 2Y, 2M, 2C, and 2K. As a result, in generating the correction table to reduce the image density fluctuation having the rotary cycle of the developing rollers 5Ya, 5Ma, 5Ca, and 5Ka, the controller 37 needs to extract the cyclic components of the developer roller from the toner deposition amount detection signal from the image density sensor 30. Also, in generating the correction table to reduce the image density fluctuation having the rotary cycle of the photoreceptor drums, the controller 37 needs to extract the cyclic component of the photoreceptor drum from the toner deposition amount detection signal output from the image density sensor 30.

For example, to extract the rotary cycle component of the developing roller from the toner deposition amount detection signal output from the image density sensor 30 includes, the toner deposition amount detection signal included in the output signal of the photointerrupter 71 at the home position detection timing may be divided, and each signal division is averaged to extract the rotary cycle component of the developing roller.

Figure 12:
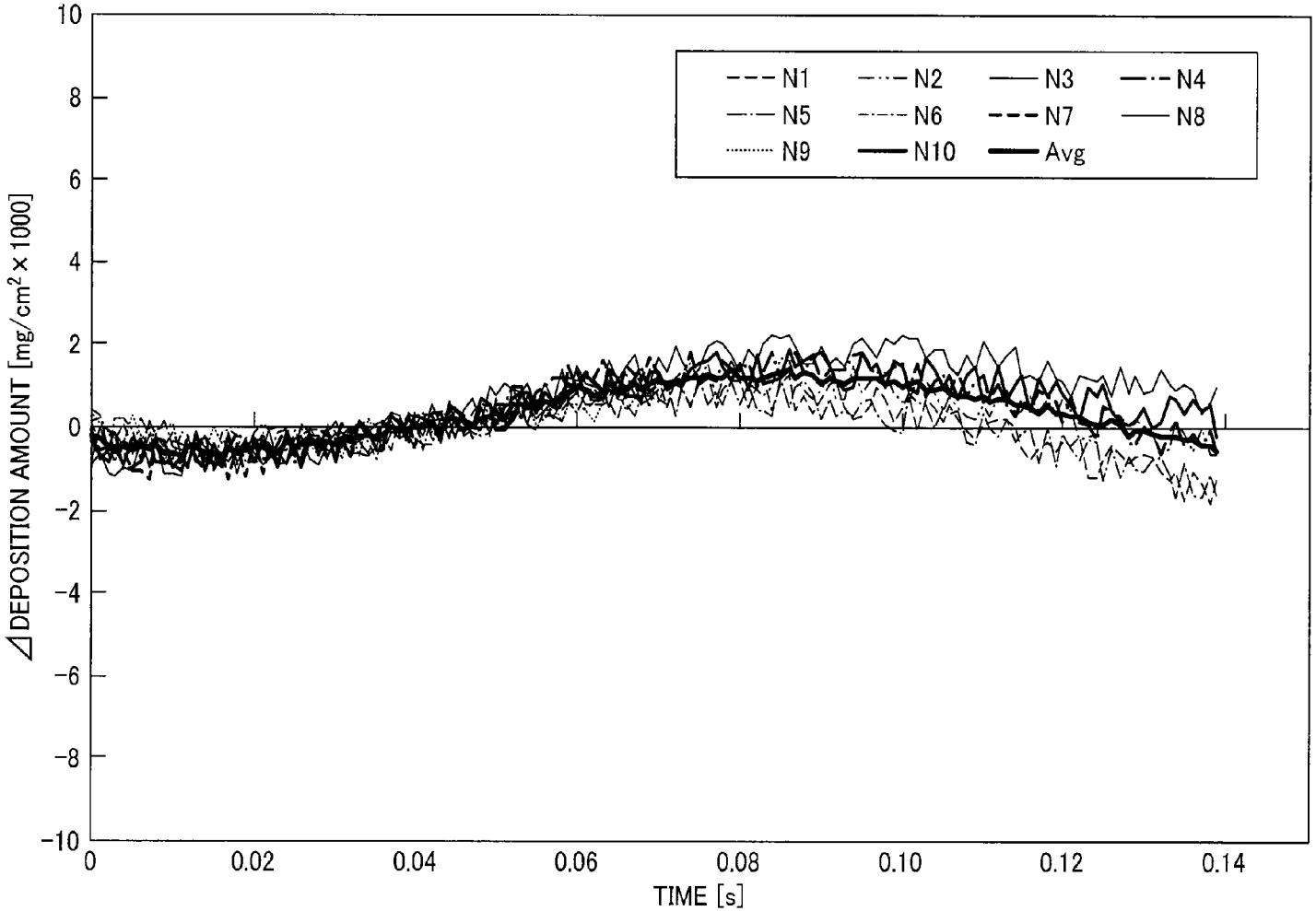
FIG. 12 is a graph illustrating a plurality of signal segments in a superimposed manner, obtained by dividing the toner deposition amount detection signal at the home position detection timing included in the output signal from the photointerrupter.

FIG. 12 is a graph illustrating a plurality of signal segments in a superimposed manner obtained by dividing the toner deposition amount detection signal at the home position detection timing included in the output signal from the photointerrupter 71.

In the present embodiment, ten signal segments N1 to N10 are obtained from the toner pattern for correction of the length corresponding to three circumferential length of the photoreceptor drum. The waveform shown by a solid line represents an averaged result of the signal segments. In the present example, ten signal segments from N1 to N10 are subjected to simple averaging process; however, once the rotary cycle component of the developing roller is extracted, other process may be applied.

Via the signal processing described above, from the toner deposition amount detection signal obtained by the image density sensor 30 that detects the toner pattern for correction, the rotary cycle component of the photoreceptor drums 2Y, 2M, 2C, and 2K and the rotary cycle component of the developing rollers 5Ya, 5Ma, 5Ca, and 5Ka can be obtained independently. When obtaining the rotary cycle component from the same toner pattern for correction, the length of the toner pattern for correction and the position thereof are set based on the longer of the circumferential lengths among the circumferential length of the photoreceptor drums 2Y, 2M, 2C, and 2K and that of the developing rollers 5Ya, 5Ma, 5Ca, and 5Ka, the rotation position, the layout distance, and the process linear speed. In the present case, the circumferential length of the photoreceptor drums 2Y, 2M, 2C, and 2K is longer and is employed.

On the other hand, when the image density fluctuation having the rotary cycle of the photoreceptor drums 2Y, 2M, 2C, and 2K is not corrected and the image density fluctuation having the rotary cycle of the developing rollers 5Ya, 5Ma, 5Ca, and 5Ka is corrected, the length of the image pattern and the position thereof are set based on the circumferential length, the rotation position, the layout distance, and the process linear speed of the developing rollers 5Ya, 5Ma, 5Ca, and 5Ka. Herein, the layout distance means a distance between the developing nip and the detection position of the toner pattern for correction by the image density sensor 30 along the sub-scanning direction.

When obtaining both the rotary cycle components of the photoreceptor drums 2Y, 2M, 2C, and 2K and the developing rollers 5Ya, 5Ma, 5Ca, and 5Ka from the same toner pattern for correction, a timing to form the toner pattern for correction is determined based on either one of the home position detection timing of the photoreceptor drums 2Y, 2M, 2C, and 2K detected by the photointerrupters 18Y, 18M, 18C, and 18K or the home position detection timing of the developing rollers 5Ya, 5Ma, 5Ca, and 5Ka detected by the photointerrupter 71. Therefore, for determining a proper timing to form the toner pattern for correction, either home position may only be detected. Specifically, it is satisfactory that either of the photointerrupters 18Y, 18M, 18C, and 18K or the photointerrupter 71 is provided.

The controller 37 as illustrated in FIG. 7 includes a correction program of the image forming condition to execute the above control or processes. Such an image forming condition correction program can be stored not only in the nonvolatile memory and/or the volatile memory disposed in the controller 37 but in semiconductor devices such as a RAM, optical devices such as a DVD, MO, MD, CD-R, and the like, or magneto-optic devices such as a Hard-Disk, magnetic tape, flexible disk, and the like. When such a memory or other storage device is used to store the image forming program, such devices may configure a computer-readable recording medium storing the image forming condition correction program.

Herein, a relation between the variations in the development gap and the development field will be described.

Figure 13:
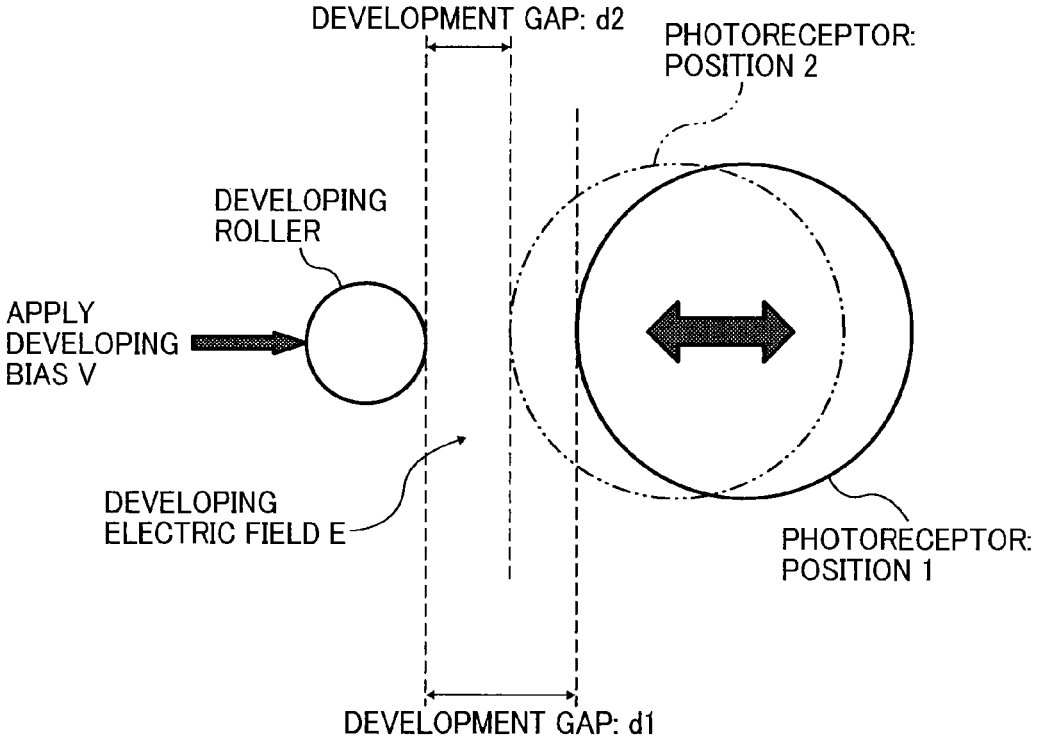
FIG. 13 is an explanatory view illustrating variations in development gap due to the eccentric rotation of the photoreceptor drum.

FIG. 13 is an explanatory view illustrating variations in the development gap due to the eccentric rotation of the photoreceptor drum.

As illustrated in FIG. 13, due to an eccentricity of the photoreceptor drum, the development gap between the developing roller and the photoreceptor drum takes a maximum value d1 at a rotation position 1 (in solid line) of the photoreceptor drum and a minimum value d2 at a rotation position 2 (in broken line) of the photoreceptor drum. The eccentric rotation of the photoreceptor drum occurs between the position 1 and the position 2. Assuming that the surface potential V of the developing roller to which the developing bias is applied is constant, when the rotation position of the photoreceptor drum is at the position 1, the development field E is at its minimum. At this time, the image density becomes relatively low. On the other hand, when the rotation position of the photoreceptor drum is at the position 2, the development field E is at its maximum and the image density becomes relatively high.

Because the photoreceptor drum rotates at a constant speed, a portion in which the toner image is developed to have a relatively low image density and a portion in which the toner image is developed to have a relatively high image density repeatedly appear in the rotary cycle of the photoreceptor drum, whereby image density fluctuation appears in the formed image. In the present embodiment, even when the development gap fluctuates, the developing bias is controlled to be changed in accordance with the detected results of the image density fluctuation (i.e., the toner deposition amount detection signal as to the toner pattern for correction), so that the image density fluctuation is minimized. The same applies to both the eccentric rotation of the developer roller and the eccentric rotation of the photoreceptor drum.

The image density fluctuates due to not only the fluctuations of the development gap but the sensitivity fluctuation of the photoreceptor drums 2Y, 2M, 2C, and 2K. When the sensitivity of the photoreceptor drums 2Y, 2M, 2C, and 2K responsive to the exposure fluctuates due to factors such as an environmental change or aging deterioration, even though the exposure is performed at a constant exposure amount, the exposed bright area potential (the potential of the latent image portion) after the exposure of the photoreceptor drums 2Y, 2M, 2C, and 2K fluctuates and a potential difference arises between the latent image portion and the surface of the developing roller. As a result, even though the same exposure amount is applied to the latent image portion, the toner deposition amount is varied, thereby causing image density fluctuation having a rotary cycle of the photoreceptor drum. With regard to the sensitivity fluctuation of the photoreceptor drums 2Y, 2M, 2C, and 2K, if the photoreceptor drums 2Y, 2M, 2C, and 2K are manufactured using a high resolution production method in order to decrease the sensitivity errors, the manufacturing cost of the photoreceptor drums 2Y, 2M, 2C, and 2K is soared, which therefore should be avoided.

<First Correction Method>

To reduce the image density fluctuation due to the eccentric rotation of the photoreceptor, a correction method to correct the developing bias as one of the image forming conditions will be described.

Figure 14:
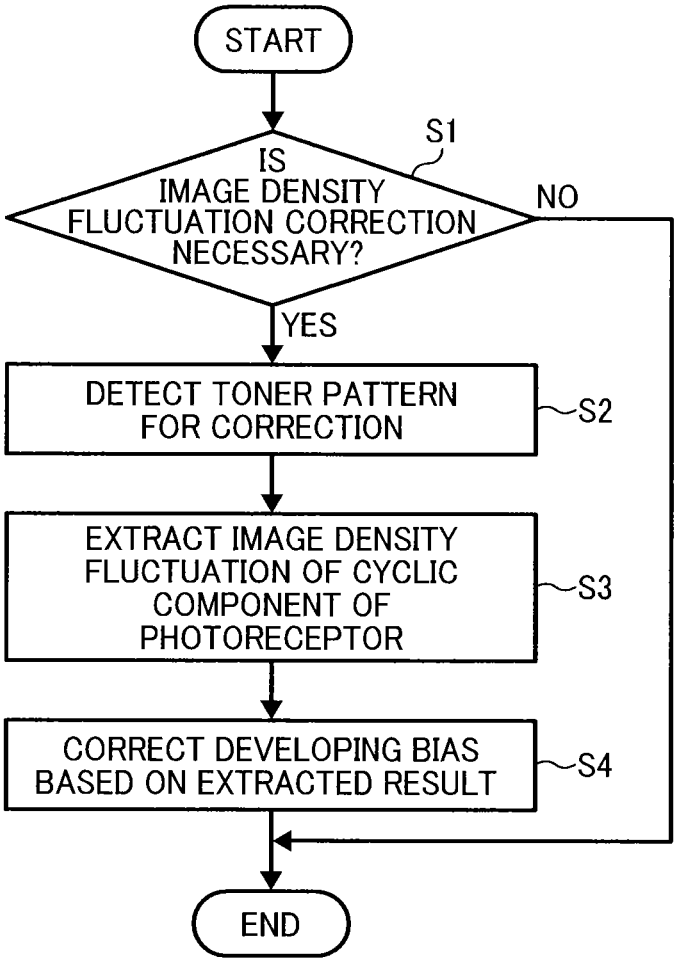
FIG. 14 is a flowchart illustrating a first correction method.

FIG. 14 is a flowchart illustrating a control flow in the first correction method.

In the first correction method, first, it is determined whether or not a correction to reduce the image density fluctuation is necessary (in Step S1). For example, when the photoreceptor drum is replaced or if the rotation position of the photoreceptor drum is changed for some reason, it is determined that the correction is necessary. If it is determined that the density fluctuation correction is necessary, a toner pattern for correction is formed and the image density is detected by the image density sensor 30 (in Step S2). The thus-obtained output signal (i.e., the toner deposition amount detection signal) from the image density sensor 30 is input to the controller 37. The controller 37 divides the toner deposition amount detection signal by the rotary cycle of the photoreceptor drum at the home position detection timing of the photointerrupter 18Y, 18M, 18C, and 18K, performs averaging process to each signal segment, and extracts the image density fluctuation component having the rotary cycle component of the photoreceptor drum (in Step S3).

The thus-extracted image density fluctuation component data of one rotary cycle of the photoreceptor drum is stored in the memory (or the image density fluctuation data storage unit) in the chronological order. Then, based on the chronological data of the image density fluctuation component, the setting value (i.e., the image forming condition setting data) of the developing bias is corrected to cancel the image density fluctuation component (in Step S4). Specifically, the controller 37 sequentially reads out the image density fluctuation component from the image density fluctuation storage unit in sync with the home position detection timing of the photoreceptor drum in the next image forming operation, sequentially calculates a developing bias correction value to correct the setting value of the developing bias to cancel the read-out image density fluctuation component data, and sequentially applies the developing bias corrected by the developing bias correction value to the developing roller. As a result, variations in the development field between the photoreceptor drum and the developing roller due to the eccentric rotation of the photoreceptor is cancelled, so that the image density fluctuation can be reduced.

Figure 15A:
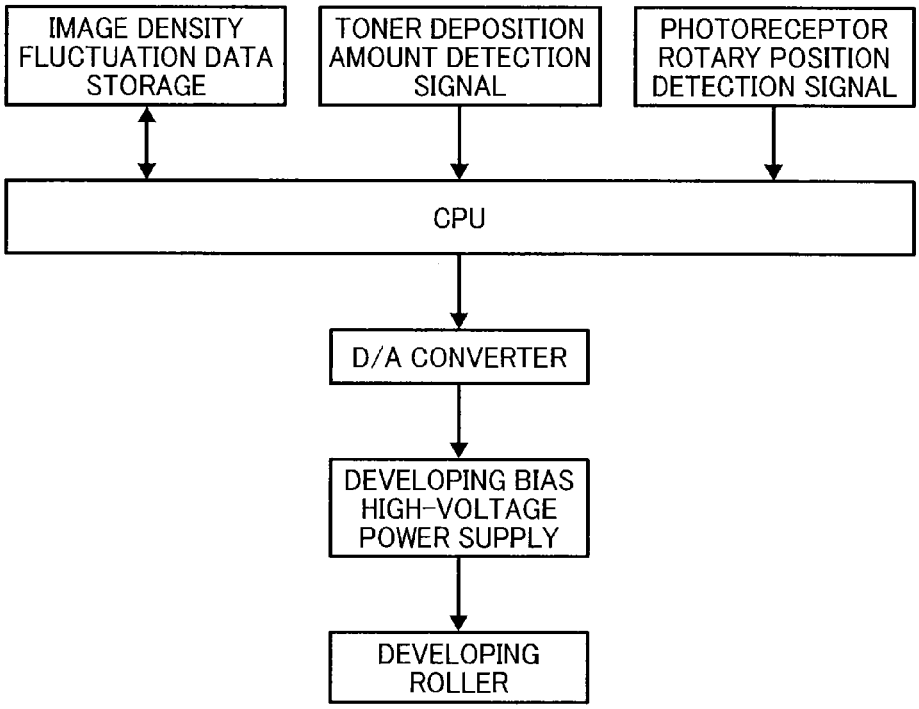
FIG. 15A is a block diagram illustrating a first structure for implementing the first correction method.

FIG. 15A is a block diagram illustrating a structure to implement the first correction method.

The controller 37 including a CPU sequentially reads out the image density fluctuation data from the image density fluctuation data storage unit in the chronological order and converts the read-out data into the correction data to correct the setting value of the developing bias. This conversion is performed in synchronization with the home position detection timing of the photoreceptor drum obtained from the photoreceptor drum rotary position detection signal and the developing bias setting value after correction is sequentially converted into analog signals by a D/A converter and is input to the developing bias high-voltage power supply. The developing bias high-voltage power supply outputs the voltage in accordance with the inputted developing bias setting value, and as a result, variations in the development field between the photoreceptor drum and the developing roller due to the eccentric rotation of the photoreceptor are canceled, so that the image density fluctuation can be reduced.

Figure 15B:
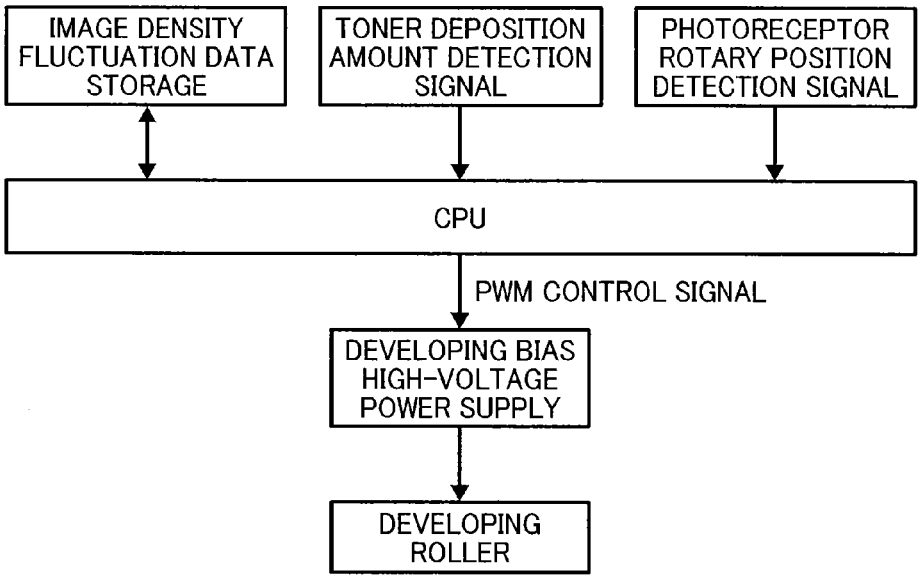
FIG. 15B is a block diagram illustrating a second structure for implementing the first correction method.

When the developing bias high-voltage power supply is controlled by the Pulse Width Modulation (PWM) method, as illustrated in FIG. 15B, the CPU generates the PWM control signal from the correction data, and outputs the PWM control signal to the developing bias high-voltage power supply in synchronization with the home position detection timing of the photoreceptor drum obtained from the photoreceptor drum rotary position detection signal. Similarly, variations in the development field between the photoreceptor drum and the developing roller due to the eccentric rotation of the photoreceptor is canceled, so that the image density fluctuation can be reduced.

<Second Correction Method>

Next, to reduce the image density fluctuation due to the eccentric rotation of the photoreceptor and the developing roller, a second correction method to correct the developing bias and the charging bias as image forming conditions will be described.

Figure 16:
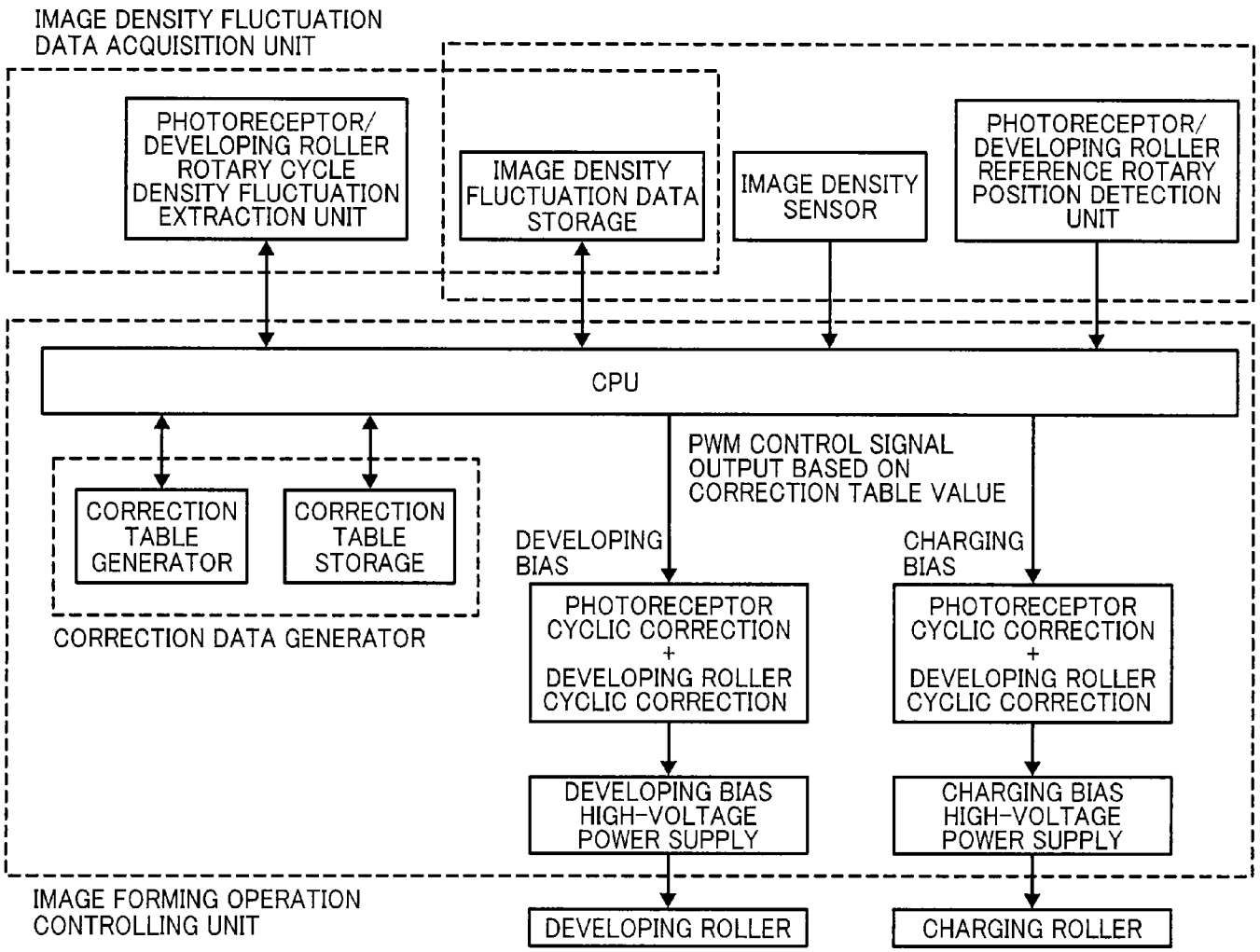
FIG. 16 is a block diagram illustrating a structure for implementing the second correction method.

FIG. 16 is a block diagram illustrating a structure to implement the second correction method.

In the second correction method, the image density fluctuation data including the rotary cycle component of the photoreceptor drum and of the developing roller is obtained from the result (i.e., the toner deposition amount detection signal) obtained by the image density sensor 30 with respect to the toner pattern for correction. This is implemented by the image density fluctuation detection unit. In the second correction method, the image density fluctuation detection unit is constructed of the reference rotary position detection unit to detect the reference rotary position or the home position of the photoreceptor drum; the image density detection unit or the image density sensor 30 to detect the image density of the toner pattern for correction; and the image density fluctuation data storage unit to store the image density fluctuation data in which the image density detected by the image density sensor 30 is provided in the chronological order.

In addition, from the thus-obtained image density fluctuation data, the image density fluctuation component having a rotary cycle component of the photoreceptor drum and the image density fluctuation component having the developing roller rotary cycle component are extracted. This is implemented by an image density fluctuation data acquisition unit. In the second correction method, the image density fluctuation data acquisition unit is constructed of the reference rotary position detection unit to detect a reference rotary position or a home position of the photoreceptor drum and the developing roller; the image density detection unit or the image density sensor 30; and the image density fluctuation data storage unit to store the image density fluctuation data, in which the image densities detected by the image density sensor 30 are provided in chronological order.

The controller to control the image forming operation includes a correction data generator to generate correction tables for the developing bias and the charging bias; and a controller to control the developing bias and the charging bias. The correction data generator includes a correction table generator to generate a correction table for use in correcting the developing bias and the charging bias; and a correction table storage unit to store the generated correction table. Further, the controller for the developing bias and the charging bias is implemented by a D/A converter to exert D/A conversion as to the output voltage based on the correction table data stored in the correction table storage unit; and a high-voltage power supply to output the developing bias and the charging bias. When the output from the high-voltage power supply is controlled by the PWM control signal, the developing bias and the charging bias controller includes a PWM control signal generator to control the output voltage based on the stored correction table data; and a high-voltage power supply to output the developing bias and the charging bias.

The CPU performs controls on charging bias output (that is, D/A conversion output or PWM control signal output), density sensor detection signal input (A/D conversion), rotary position detection signal input of the rollers such as the photoreceptor or the developing roller, correction table calculation operation, read/write to and from the memory being a storage unit, correction frequency count, time count by a timer, temperature/moisture sensor detection signal input (A/D conversion), and the like.

Figure 17:
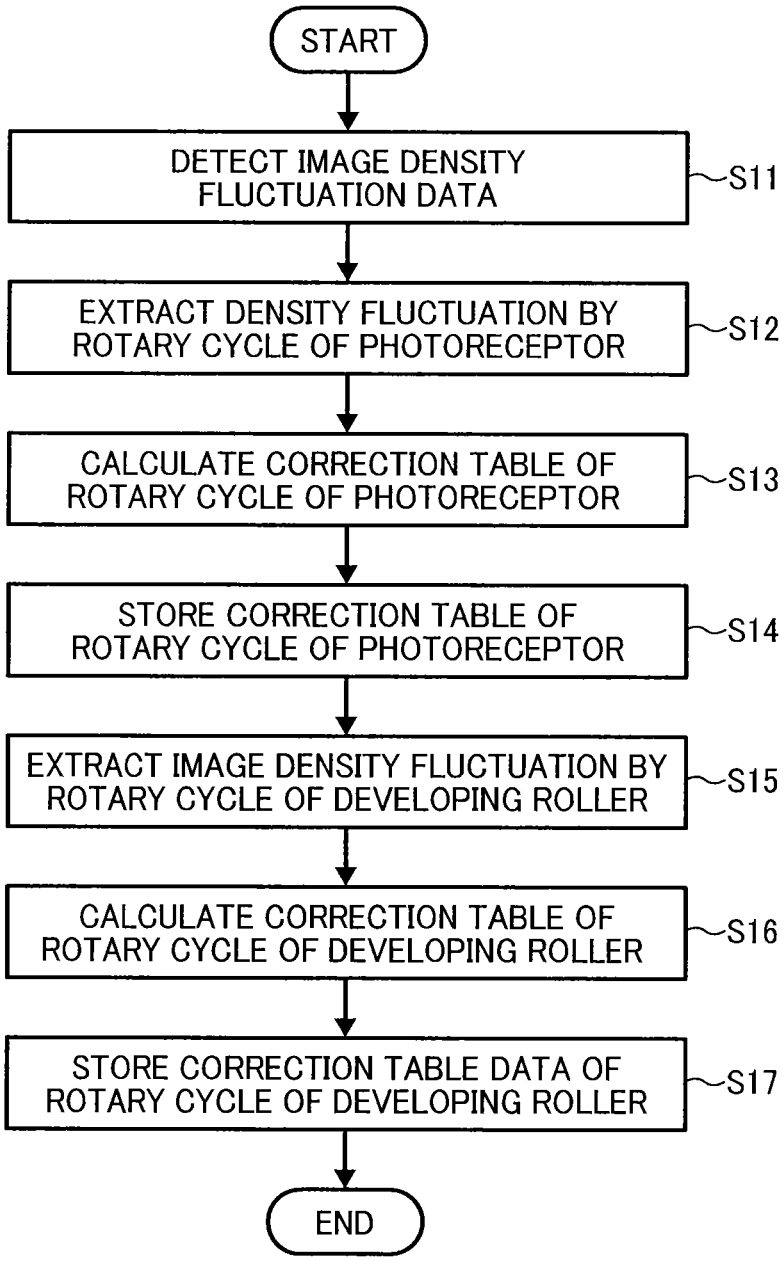
FIG. 17 is a flowchart illustrating a second correction method.

FIG. 17 is a flowchart illustrating a control flow in the second correction method.

First, a toner pattern for correction of a solid image is formed using the developing bias and the charging bias in accordance with the image forming conditions determined by an ordinary image quality adjusting control or a process control. The thus-formed toner pattern for correction is detected by the image density sensor 30 to obtain the image density fluctuation data and the obtained image density fluctuation data is stored in the image density fluctuation data storage unit (S11). Thereafter, from the image density fluctuation data stored in the image density fluctuation data storage unit, the image density fluctuation component of the photoreceptor drum rotary cycle is extracted with reference to the home position detection timing of the photoreceptor drum (S12).

Figure 18A:
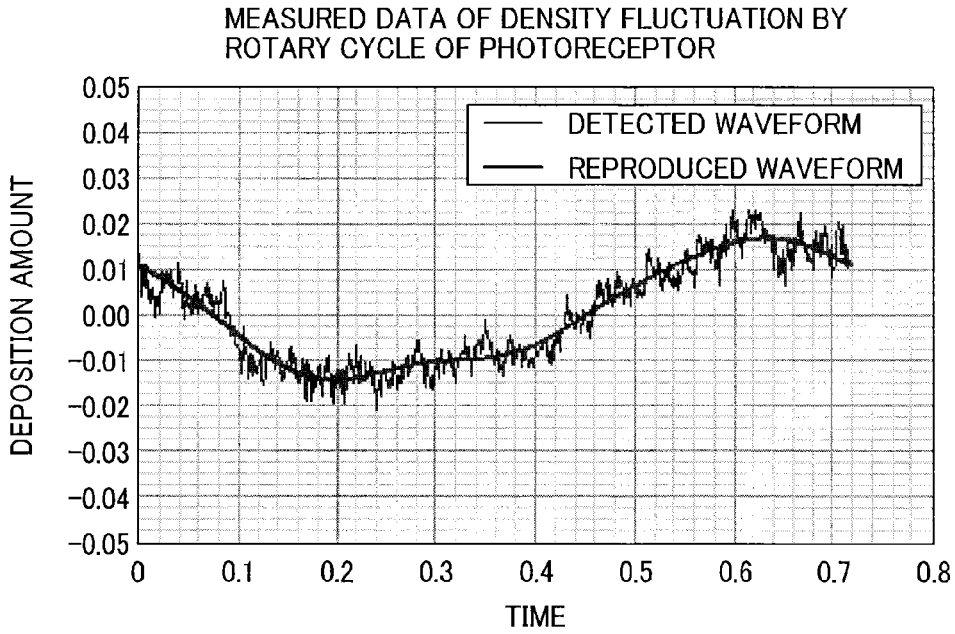
FIG. 18A is a graph of a measured image density fluctuation data of one cycle of the photoreceptor drum.
Figure 18B:
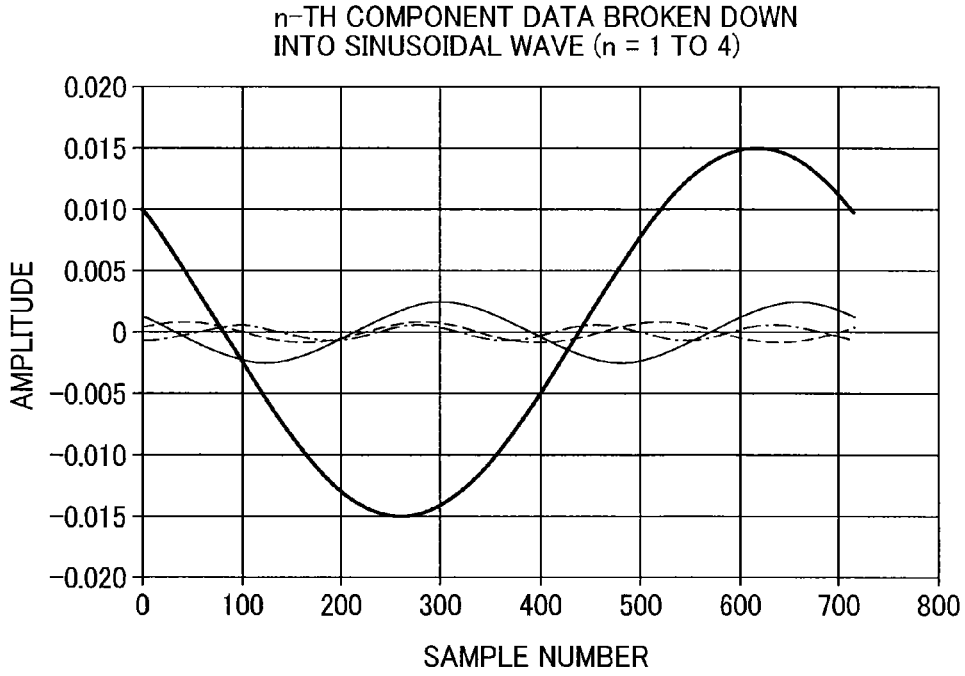
FIG. 18B is a graph of n-th components (n=1 to 4) of the rotational frequency of the photoreceptor drum broken down into a sinusoidal wave obtained by analyzing the measured result in FIG. 18A.

FIG. 18A is a graph of a measured image density fluctuation data of one cycle of the photoreceptor drum. FIG. 18B is a graph of n-th components (n=an integer from 1 to 4) of the rotational frequency of the photoreceptor drum broken down into a sinusoidal wave obtained by analyzing the readings in FIG. 18A.

Figure 19A:
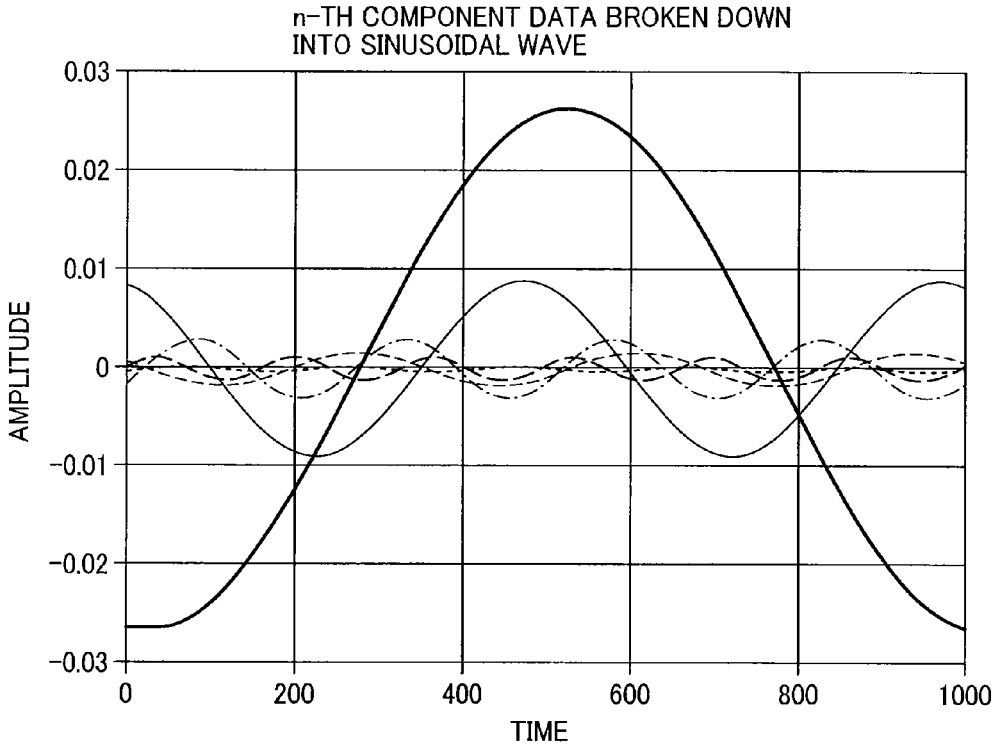
FIG. 19A is a graph of n-th components (n=1 to 4) of the rotational frequency of the photoreceptor drum broken down into a sinusoidal wave obtained by analyzing the measured result of the image density fluctuation data.
Figure 19B:
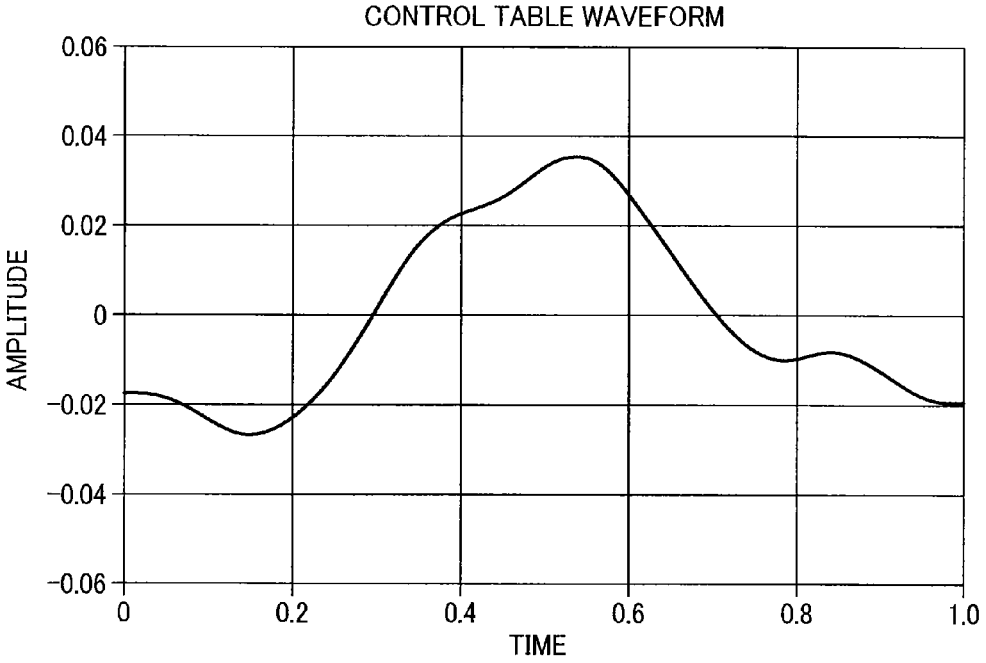
FIG. 19B is a synthesized graph from four waveforms in FIG. 19A showing image density fluctuation components of the rotary cycle of the photoreceptor drum.

FIG. 19A is a graph of n-th components (n=1 to 4) of the rotational frequency of the photoreceptor drum broken down into a sinusoidal wave obtained by analyzing the readings of the image density fluctuation data. FIG. 19B is a synthesized graph from four waveforms in FIG. 19A showing image density fluctuation components of the rotary cycle of the photoreceptor drum.

There is a method to extract the image density fluctuation component of the photoreceptor drum rotary cycle, in which the image density fluctuation data obtained from the toner pattern for correction is subjected to fast Fourier transformation (FFT) process or orthogonal waveform detection process, an amplitude and a phase of the n-th component of the photoreceptor rotation frequency, and the density fluctuation component due to the photoreceptor drum rotary cycle is extracted from the synthesized waveform of the n-th component of the photoreceptor drum rotary cycle. Herein, 'n' is an order number when the rotary cycle of the photoreceptor drum is subjected to frequency analysis.

Accordingly, when the image density fluctuation component of the rotary cycle of the photoreceptor drum has been extracted, correction tables for the developing bias and for the charging bias are generated respectively from the analyzed waveform of the image density fluctuation components multiplied by 1 to k (herein, k is an order number of the correction table formed by 1st to k-th ($k \leq n$) components) (S13). Based on this, each correction table is generated for one rotary cycle of the photoreceptor drum and is stored in the correction table storage unit (S14).

Next, from the image density fluctuation data stored in the image density fluctuation data storage unit, the image density fluctuation component of the n-th component of the developing roller rotation frequency of the rotary cycle of the developing roller is extracted with reference to the home position detection timing of the developing roller (S15). Then, from the synthesized waveform of the image density fluctuation component obtained by multiplying with 1 to k among the extracted image density fluctuation component of the developing roller rotary cycle, correction tables for the developing bias and for the charging bias are generated (S16). Based on this, each correction table is generated for one rotary cycle of the photoreceptor drum and is stored in the correction table storage unit (S17).

In the second correction method, because the image density fluctuation component of both the photoreceptor drum rotary cycle and the developing roller rotary cycle is removed, correction process is performed to both rotary cycle components; however, depending on the occurrence of the image density fluctuation of those rotary cycle components and the customers' requirements, it is possible to perform correction process of either one alone.

Further, in the second correction method, both the developing bias and the charging bias are corrected; however, correction of either one alone is possible. In addition, the correction control may be performed using the write exposure amount.

One example of a calculation formula used when obtaining the developing bias after the correction using the data of the image density fluctuation component of the photoreceptor drum rotary cycle is shown below:

$$Vb=Vb_{ofs}+\{A_1\times\sin(\theta+\phi_1)+A_2\times\sin(2\theta+\phi)+\ldots+A_n\times\sin(n\theta+\phi_n)\} \quad (1)$$

Herein, Vb is a setting value of the developing bias after correction; $Vb_{ofs}$ is a reference developing bias (offset) determined by the image adjusting control; $A_n$ is an amplitude of n-th component; $\phi_n$ is a phase of n-th component; and θ is a rotation position of the photoreceptor drum.

Because each amplitude $A_n$ broken down into the n-th component of sinusoidal wave of the photoreceptor drum rotation frequency has different damping characteristics, the difference needs to be corrected. Then, as shown in the following formula (2), a gain $G_n$ is multiplied to perform control on the amplitude. ($G_n$ is an n-th component of the amplitude control gain.)

$$Vb=Vb_{ofs}+\{G_1\times A_1\times\sin(\theta+\phi_1)+G_2\times A_2\times\sin(2\theta+\phi)+\ldots+G_n\times A_n\times\sin(n\theta+\phi_n)\} \quad (2)$$

Further, in order to correct the amplitude entirely over the corrected components, the amplitude control may be performed by the setting value of the developing bias Vb obtained by further multiplying the formula (2) by the developing bias gain Gb.

$$Vb=Vb_{ofs}+Gb\times\{G_1\times A_1\times\sin(\theta+\phi_1)+G_2\times A_2\times\sin(2\theta+\phi)+\ldots+G_n\times A_n\times\sin(n\theta+\phi_n)\} \quad (3)$$

Herein, as shown in the formula (3), the correction table is calculated by multiplying the gain that corrects the damped value to each amplitude broken down into the n-th component of sinusoidal wave of the photoreceptor drum rotation frequency and the whole correction target, thereby modulating the developing bias with an optimal correction condition and correcting the image density fluctuation.

The same controlling may be applied to the charging bias, which will be described later.

Next, a description will be given of updating of the correction table according to an embodiment of the present invention.

Figure 20:
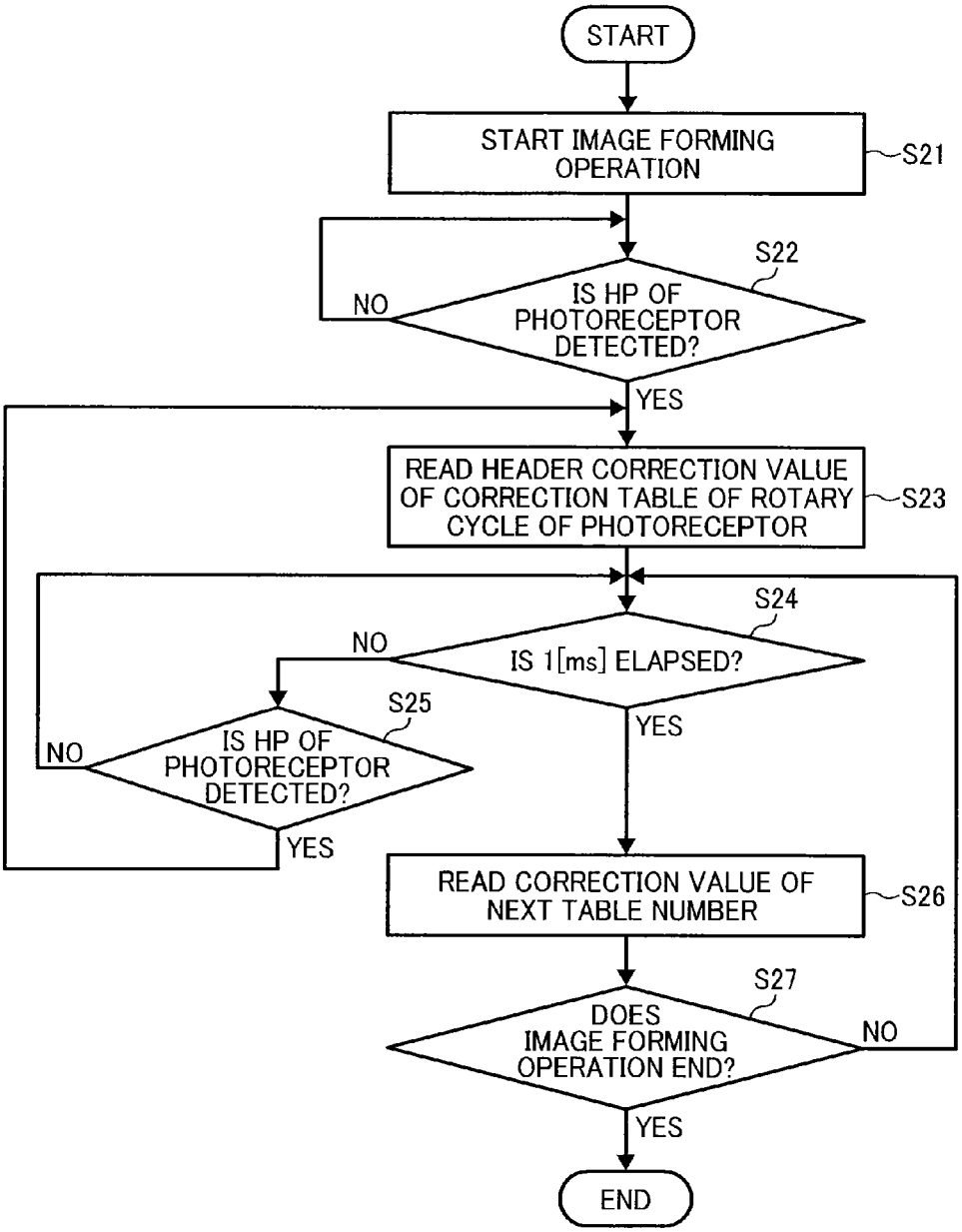
FIG. 20 is a flowchart showing updating of the correction table of the rotary cycle of the photoreceptor drum.

FIG. 20 is a flowchart showing the updating process of the correction table of the rotary cycle of the photoreceptor drum.

In the present embodiment, the updating cycle of the correction table of the photoreceptor drum rotary cycle is set to 1 [ms] with reference to the home position detection timing of the photoreceptor drum. The updating cycle corresponds to a cycle to read each correction value—each correction value corresponding to the rotary position of the photoreceptor drum—written in the correction table in the chronological order. Specifically, after the image forming operation is started (S21), when the home position of the photoreceptor drum is detected (S22), a head correction data in the correction table is read (S23). Thereafter, each time one millisecond has passed (S24), the correction value in the next table number is read (S26). Specifically, after the image forming operation is started (S21), upon the home position of the photoreceptor drum is detected (S22), a head correction value data in the correction table is read (S23). Thereafter, each time one millisecond has passed (S24), the correction value in the next table number is read (S26). Normally, after the correction value data corresponding to the final table number of the correction table is read, until one millisecond has passed, a next home position of the photoreceptor drum is detected (S25), and again, the correction value is sequentially read from the head correction value data in the correction tale.

Figure 21:
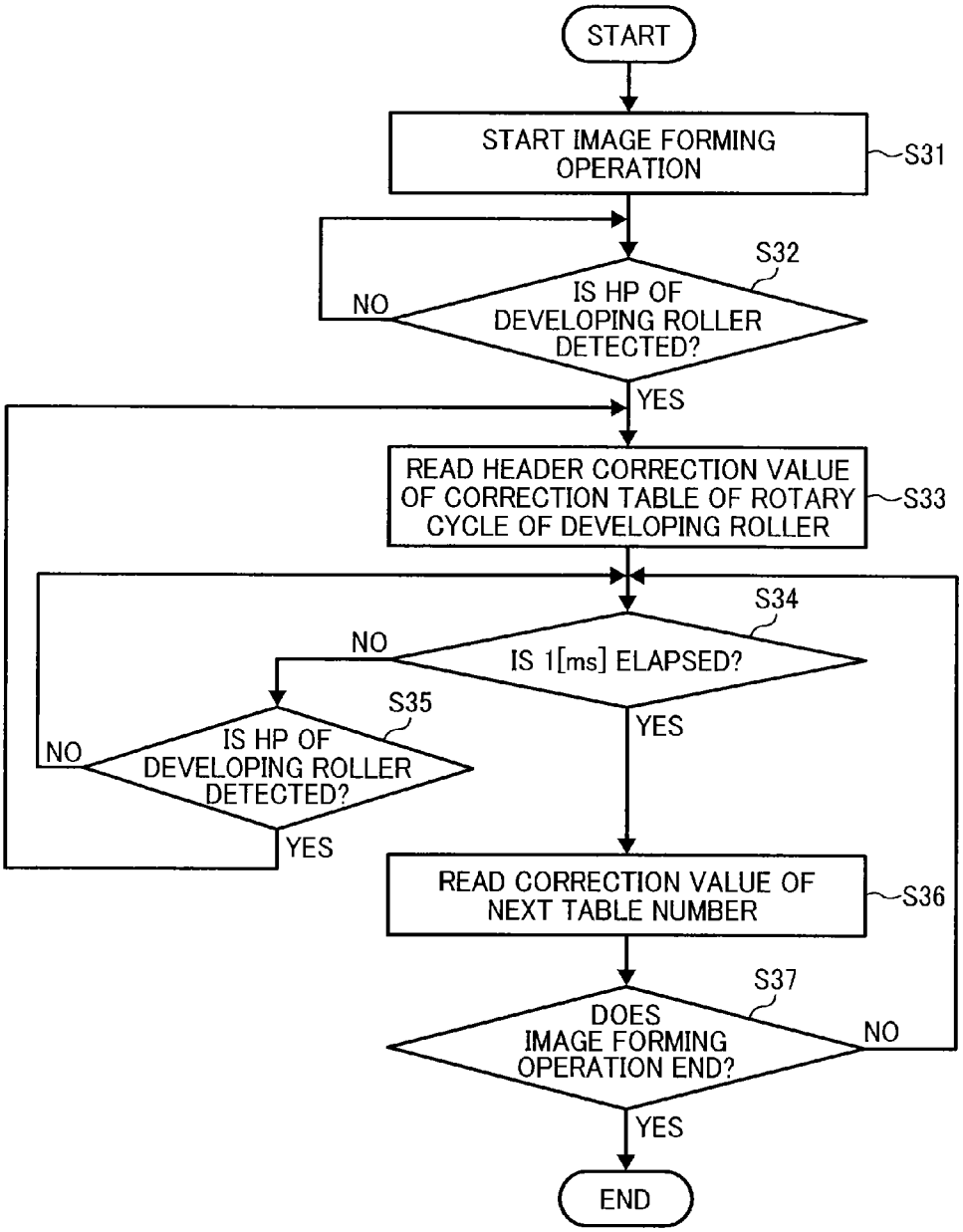
FIG. 21 is a flowchart showing updating of the correction table of the developing roller rotary cycle.

FIG. 21 is a flowchart showing updating of the correction table of the developing roller rotary cycle.

Similarly, the updating cycle of the correction table of the developing roller rotary cycle is set to 1 [ms] with reference to the home position detection timing of the developing roller. Specifically, after the image forming operation is started (S31), upon the home position of the developing roller is detected (S32), a head correction value data in the correction table is read (S33). Thereafter, each time one millisecond has passed (S34), the correction value in the next table number is read (S36). Normally, after the correction value data corresponding to the final table number of the correction table is read, until one millisecond has passed, a next home position of the developing roller is detected (S35), and again, the correction value is sequentially read from the head correction value data in the correction tale.

The cycle to correct the setting value of the developing bias by the read correction value from the correction table for the developing bias and the setting value of the charging bias by the read correction value from the correction table for the charging bias is in either case one millisecond. In the present embodiment, updating timing of the correction table of the photoreceptor drum rotary cycle (i.e., the correction value read timing), updating timing of the correction table of the developing roller (i.e., the correction value read timing), and the setting value output timing of the developing bias and the charging bias after correction are asynchronous to each other.

Figure 22:
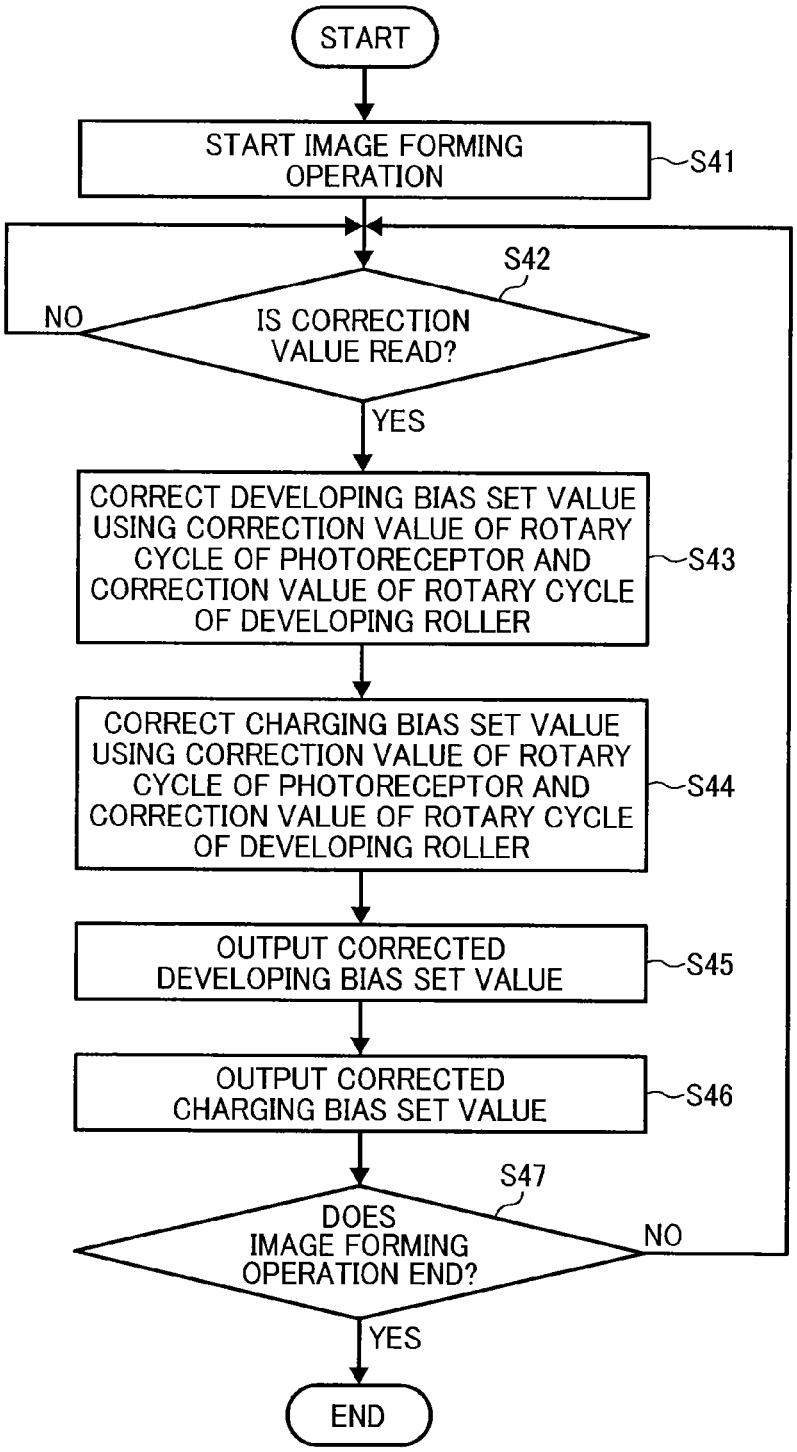
FIG. 22 is a flowchart showing updating of the developing bias and the charging bias.

FIG. 22 is a flowchart showing the updating process of the developing bias and the charging bias.

Updating or correction of the setting value of the developing bias and the charging bias is performed (S43, S44) after the image forming operation is started (S41), and each time the correction value is read (S42). In addition, each time the setting value of the developing bias and the setting value of the charging bias are updated or corrected, the corrected developing bias setting value and the charging bias setting value are output (S45, S46). The output developing bias setting value is the developing bias determined previously by the image quality adjustment process added to the correction value read from the correction table for the developing bias of the photoreceptor drum rotary cycle and the correction value read from the correction table for the developing bias of the developing roller rotary cycle (S43). The output developing bias setting value is the developing bias determined previously by the image quality adjustment process added to the correction value read from the correction table for the developing bias of the photoreceptor drum rotary cycle and the correction value read from the correction table for the developing bias of the developing roller rotary cycle (S44).

Figure 23:
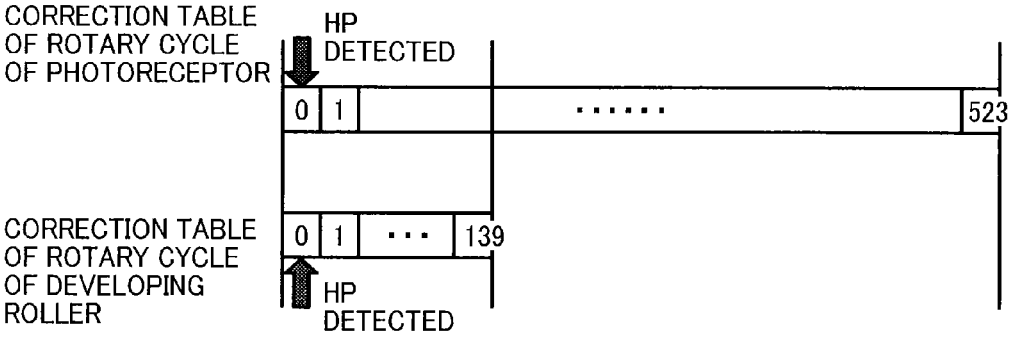
FIG. 23 is an explanatory view illustrating storage data of the correction tables of the photoreceptor drum rotary cycle and the developing roller rotary cycle according to an embodiment of the present invention.

FIG. 23 is an explanatory view illustrating storage data of the correction tables of the photoreceptor drum rotary cycle and the developing roller rotary cycle. In the present embodiment, the image forming apparatus 100A as illustrated in FIG. 1 includes a photoreceptor drum having a diameter of 50 mm and a developing roller having a diameter of 20 mm. Because rotational speed (linear speed) of the photoreceptor drum is 300 mm/s and that of the developing roller is 450 mm/s, the rotary cycle of the photoreceptor drum is 523.6 ms and that of the developing roller is 139.6 ms. Because the updating cycle or the correction value read cycle of each correction table is 1 ms, the correction table of the photoreceptor drum rotary cycle—one revolution of the photoreceptor drum 1—includes from the head table 0 that is defined to correspond to the home position detection timing, to the final table 523. Similarly, the correction table of the developing roller rotary cycle—one revolution of the developing roller—includes from the head table 0 that is defined to correspond to the home position detection timing, to the final table 139.

If the photoreceptor drum appropriately rotates at the same rotary cycle when the correction table has been generated and the home position of the photoreceptor drum is normally detected at each rotary cycle, the home position of the photoreceptor drum is detected before one millisecond passes after the correction value of the final table of the correction table has been read. Then, at a next updating timing when the correction value of the final table number is read, the correction value of the head table number of the correction table is again read. Thereafter, the correction value is sequentially read in the order of the table number each time one millisecond has passed. The same stands for the developing roller.

However, it may happen that the home position of the photoreceptor drum is not detected before one millisecond passes after the correction value of the final table number of the correction table has been read. Specifically, 523.6 milliseconds have elapsed after the home position of the photoreceptor drum has been detected, the home position is again detected normally, but such an occasion may occur that the home position is not detected even after 524 milliseconds have elapsed. In such a case, the correction table does not include corresponding correction value data. In this case, if an indefinite value is used as the correction value or the correction data of the final table number is used as is in each updating time after 524 milliseconds have elapsed, the image density fluctuation may be generated newly.

Accordingly, in the present embodiment, if the home position is not detected after one millisecond has passed since the updating timing using the final table number of the correction table, it is assumed that the home position is detected at the timing after one millisecond has passed from the updating timing using the correction value of the final table number of the correction table. Then, the correction value of the head table number of the correction table is read, and, the correction value is read sequentially in the order of the table number each time one millisecond has passed.

Figure 24:
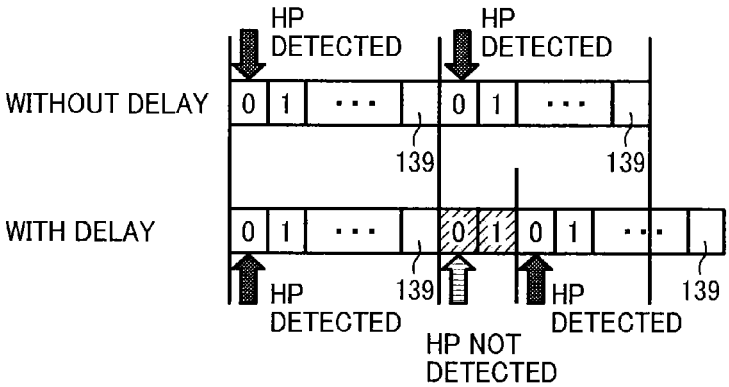
FIG. 24 is an explanatory view illustrating a relation between a home position detection timing and each correction value in a case in which the developing roller slightly is delayed temporarily and the home position detection timing is delayed.

For example, as illustrated in FIG. 24, when the linear speed of the developing roller changes due to a change in the load and the like, and the developing roller is slightly delayed temporarily and the home position detection timing is delayed by 2 ms. In this case, in the present embodiment, when one millisecond has passed from the updating timing using the correction value of the final table number 139, a correction value of the head table number 0 of the correction table is read. And further, when one millisecond has passed, a correction value of the next table number 1 is read. Then, because the home position is detected before the next one millisecond has passed, at a timing after the next one millisecond has passed, the correction value of the head table number of the correction table is read, and thereafter, the correction value is sequentially read in the order of the table number each time one millisecond has passed.

In this case, although there is a difference from the correction table for the actual photoreceptor drum rotary cycle, the difference is a slight timing error, and the image density fluctuation data is continuous and there is little difference from the adjacent fluctuation. Thus, no drastic change is caused in the image density, and an effect to reduce the image density fluctuation of the rotary cycle of both the photoreceptor drum and the developing roller fully remains.

Figure 25:
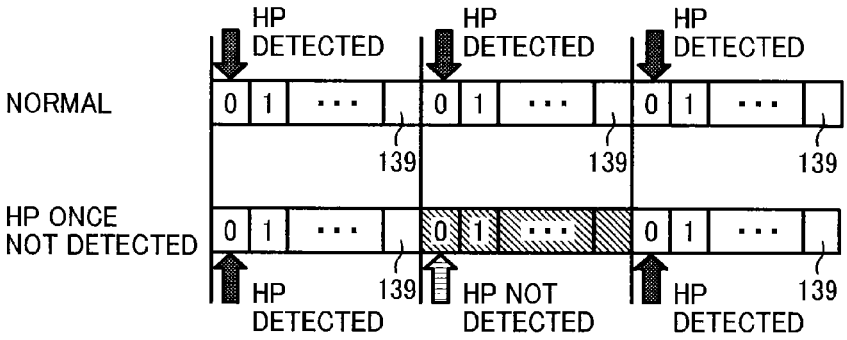
FIG. 25 is an explanatory view illustrating a relation between the home position detection timing and each correction value in a case in which a home position is not detected at a certain cycle.

Suppose, for example, a case in which the home position of a certain rotary cycle is not detected due to an effect of the noise as illustrated in FIG. 25. In this case, in the present embodiment, when one millisecond has passed from the updating timing using the correction value of the final table number 139, a correction value of the head table number 0 of the correction table is read, and thereafter, the correction value is sequentially read each time one millisecond has passed up to the final table number 139. Then, because the home position is detected before the next one millisecond has passed after the correction value of the final table number 139 is read, the correction value of the head table number of the correction table is read, and thereafter, the correction value is sequentially read in the order of the table number each time one millisecond has passed.

The above processing is effective when a temporary slight speed change occurs to the photoreceptor drum or the developing roller or a temporary home position detection error occurs. However, when the drastic rotational speed fluctuation occurs to the photoreceptor drum or the developing roller or when the home position is not detected at all, the correction process is performed without synchronizing the updating timing of the correction table, i.e., the timing to read the correction value, with the rotation operation of the photoreceptor drum of the developing roller. In such a case, the difference between the updating timing of the correction table, i.e., the timing to read the correction value, and the rotary position of the photoreceptor drum or the developing roller is accumulated, so that a greater image density fluctuation may be caused. In such a case, it is appropriate to stop the correction process at a predetermined timing.

Figure 26:
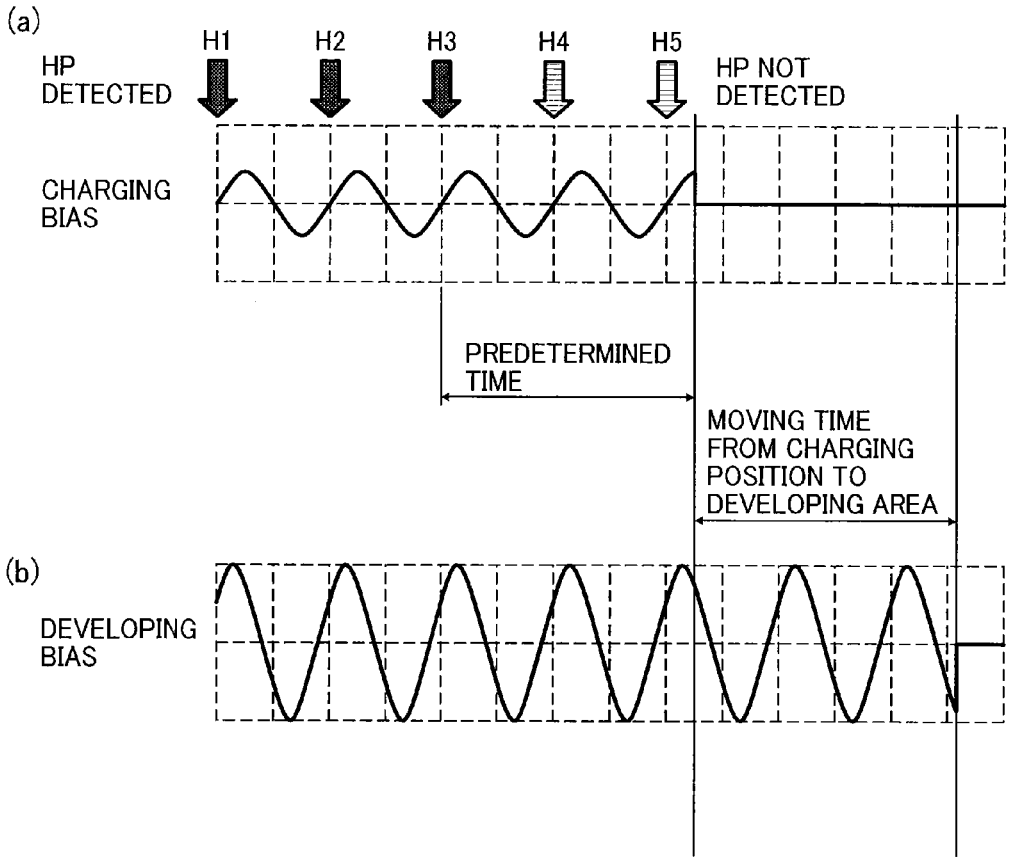
FIG. 26(*a*) is a timing chart to show a timing to stop the correction control of the charging bias when a predetermined time has passed since the home position was detected for the last time.

FIG. 26 is a timing chart to show a timing to stop the correction control when a predetermined time has passed since the home position was detected last time and the home position is not detected.

Herein, a method to stop the correction control using the correction table of the photoreceptor drum rotary cycle when the home position of the photoreceptor drum is not detected will be described, which will be applied to a case in which the correction control using the correction table of the developing roller rotary cycle is stopped when the home position of the developing roller is not detected.

In an example as illustrated in FIG. 26, the home positions H1, H2, and H3 of the photoreceptor drum are detected at the photoreceptor drum rotary cycle, but the home position H4 and later ones are not detected any more. The probable reason for the impossibility of detecting the home position may include failure of the photointerrupters 18Y, 18M, 18C, and 18K and shielding of the optical path due to an adhesion of the toner to the photointerrupters 18Y, 18M, 18C, and 18K. If the home position of the photoreceptor drum cannot be detected for one or several cycles for some reason, although during that period the correction control is not performed in synchronization with the rotary cycle of the photoreceptor drum, when the photoreceptor drum rotational speed error is small, the correction control is continued as described above, and the image density fluctuation component of the photoreceptor drum rotary cycle can be reduced continuously, assuming that the home position is detected at the timing after one millisecond has passed from the updating timing using the correction value of the final table number of the correction table. Then, the correction value of the head table number of the correction table is read, and the correction value is read sequentially in the order of the table number each time one microsecond has passed. However, even though the rotational speed error of the photoreceptor drum is small, if the photoreceptor drum continues to rotate without detecting the home position, the timing error between the rotation of the photoreceptor drum and the correction control accumulates and the accumulated error causes a new image density fluctuation.

Then, in the present embodiment, at a predetermined timing after a predetermined time has passed since the home position was detected last time, the correction process to reduce the image density fluctuation component of the rotary cycle of the rotary member (herein, the photoreceptor drum) of which the home position has not been detected is controlled to be stopped. Herein, when the home position detection of the developing roller is normally executed, the correction control to reduce the image density fluctuation component of the rotary cycle of the developing roller is not stopped and is continued. The correction control of both the photoreceptor drum and the developing roller can be stopped, but in this case, immediately after the correction control is stopped, the image density fluctuation of the rotary cycle of the both members suddenly appears, which is not preferable because the image density fluctuation tends to be observed by human eyes.

As to the predetermined time from when the home position has been detected last until the correction control is stopped, in the example depicted in FIG. 26, the predetermined time is from the timing H3 at which the home position was last detected lastly until two and a quarter rotation time has elapsed. To determine the predetermined time, various factors should be considered by experiment lest any effect should occur to the image density fluctuation due to accumulated error.

In the present embodiment, as illustrated in FIG. 26(*a*), all the correction values of the correction table for the charging bias of the photoreceptor drum rotary cycle are reset to zero when the home position of the photoreceptor drum is not detected even after the predetermined time has elapsed. With this control, no correction control to reduce the image density fluctuation of the photoreceptor drum rotary cycle by the chargers 3Y, 3M, 3C, and 3K is performed.

Then, after a further predetermined time t has passed, as illustrated in FIG. 26(*b*), all the correction values of the correction table for the developing bias of the photoreceptor drum rotary cycle are reset to zero. With this control as well, no correction control to reduce the image density fluctuation of the photoreceptor drum rotary cycle by the developing units 5Y, 5M, 5C, and 5K is performed. The predetermined time t is the time period required for the photoreceptor drum to move from the charging position where it is charged by the charger 3Y to the developing area. If the circumferential length of the photoreceptor drum from the charging position to the developing area is set to d and the rotational speed (process linear speed) of the photoreceptor drum is set to V, t is obtained by t=d/V.

FIGS. 27A to 27E each are explanatory views illustrating a timing to set all the correction values in the correction table to zero when the home position cannot be detected.

Figure 27A:
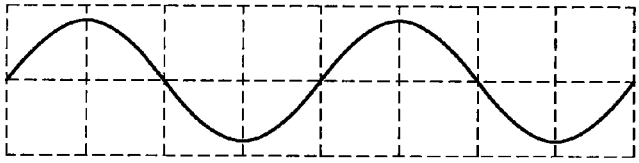
FIGS. 27A to 27E each are explanatory views illustrating a timing to set all the correction values in the correction table to zero when the home position cannot be detected.
Figure 27B:
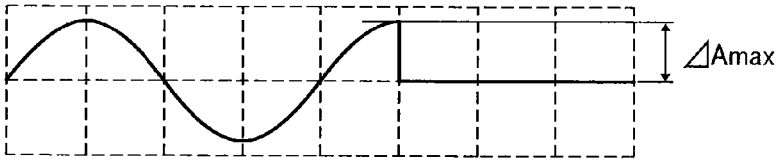

When the home position is appropriately detected each time the photoreceptor drum rotates once, the charging bias corrected by the correction values of the correction table of the photoreceptor rotary cycle changes with time as illustrated in FIG. 27A and shows continuous waveforms of the photoreceptor rotary cycle. If the home position is not detected, as illustrated in FIG. 27B, when the correction value of the correction table is set to zero at a timing in which the correction value is maximum, that is, an amplitude A of the charging bias is maximum, the difference AA of the charging bias just before and after the timing becomes the maximum AA max. In this case, the change in the image density before and after the timing becomes the maximum, and the change in the image density when the correction control is stopped is remarkably observed by human eyes.

Figure 28:
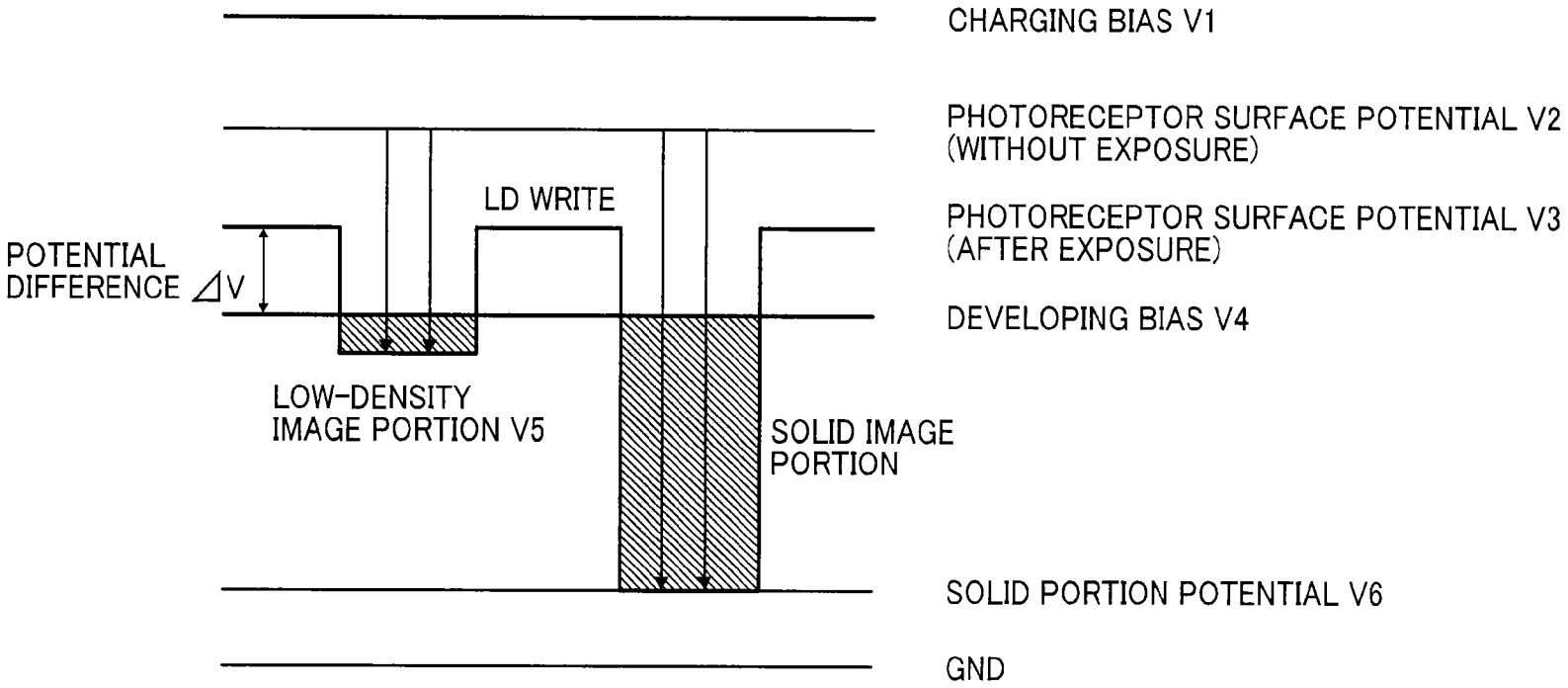
FIG. 28 illustrates potentials of the charging bias, blank image portion and image portion with low density image and solid image of the photoreceptor drum, and the developing bias.

Referring to FIG. 28, the advantage of setting the timing to stop the correction control when the home position is not detected when the absolute value of the correction value is small will be described.

The surface of the photoreceptor drum is uniformly charged by the charger 3Y, 3M, 3C, or 3K that applies the charging bias V1. As a result, the surface potential, i.e., the potential of the blank image portion, of the photoreceptor drum is charged at V3. Next, the image portion is exposed. With this operation, a low-density image portion of the photoreceptor drum surface potential becomes V5, and a solid image portion of the photoreceptor drum surface potential becomes V6. Next, toner on the developing roller is moved to an image portion of the photoreceptor drum to be developed by the developing bias V4 applied by the developing roller. Herein, on the low-density image portion and the solid image portion (or the high-density image portion), the toner corresponding to the potential difference of the shaded portion in FIG. 28 is adhered, so that a toner image is formed. If the potential difference ΔV between the blank image portion potential V3 of the photoreceptor drum and the developing bias V4 is large, carrier adhesion may occurs. By contrast, if the potential difference ΔV is small, background contamination may occur.

When the correction control using the correction table is performed, the charging bias, i.e., the blank image portion potential of the photoreceptor drum, and the developing bias are periodically changed due to the correction control by the correction table. From this state, when the correction control is stopped, because the correction value becomes zero, if the absolute value of the correction value is a maximum value, the potential difference ΔV between the blank image portion potential V3 and the developing bias V4 suddenly changes, thereby causing the carrier adhesion or the background contamination to occur.

Figure 27C:
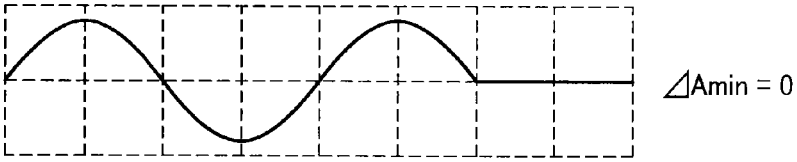
Figure 27D:
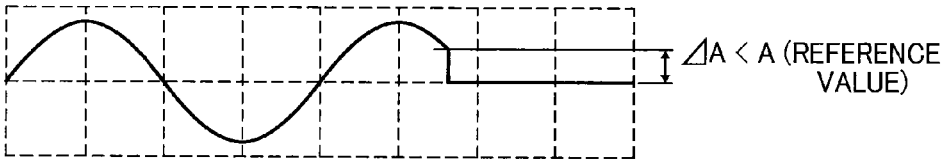
Figure 27E:
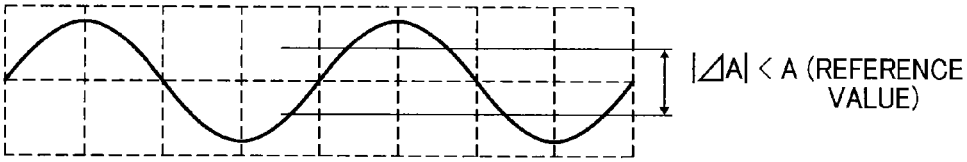

By contrast, as illustrated in FIG. 27C, the correction value of the correction table is set to zero when the correction value is minimum (zero), that it, when the amplitude A of the charging bias is minimum, the difference ΔA of the charging bias before and after the timing becomes the minimum ΔAmin. In this case, there is no change in the image density before and after the timing, and there is no change in the image density when the correction control is stopped. Further, because the potential difference ΔV between the blank image portion potential V3 and the developing bias V4 does not change before and after the correction control is stopped, there is no carrier adhesion nor the background contamination. Accordingly, it is preferred that the correction control be stopped when the correction value used for correcting the charging bias is near zero. FIG. 27D shows a case in which the correction value of the correction table is set to zero when the correction value is not a minimum but becomes a smaller value than the previously set threshold. This threshold is set such that the difference ΔA of the charging bias before and after the correction control stop timing becomes less than a reference value A. This reference value A is experimentally obtained by changing the bias in experiments, and such that the image density fluctuation is in an admissible range and there is no carrier adhesion nor background contamination.

In the present embodiment, the correction value of the correction table is set to zero when the absolute value of the difference ΔA of the charging bias before and after the correction control stop timing becomes less than the reference value A. With this operation, even when the stop timing of the correction control is performed during the charging process or the developing process with respect to one image, the change in the image density before and after that timing may be kept within an admissible range. Herein, a case in which the correction control is stopped by the correction table for the charging bias has been described; however, the same correction control may be applied to the correction table for the developing bias. However, the timing to stop the correction control of the charging bias is prior to the timing to stop the correction control of the developing bias by a moving time t from the charging position to the developing area. However, this time t is previously obtained, and therefore, based on the correction table for the developing bias and this relation, the timing to stop the correction control of the correction table of the charging bias can be obtained.

Figure 29:
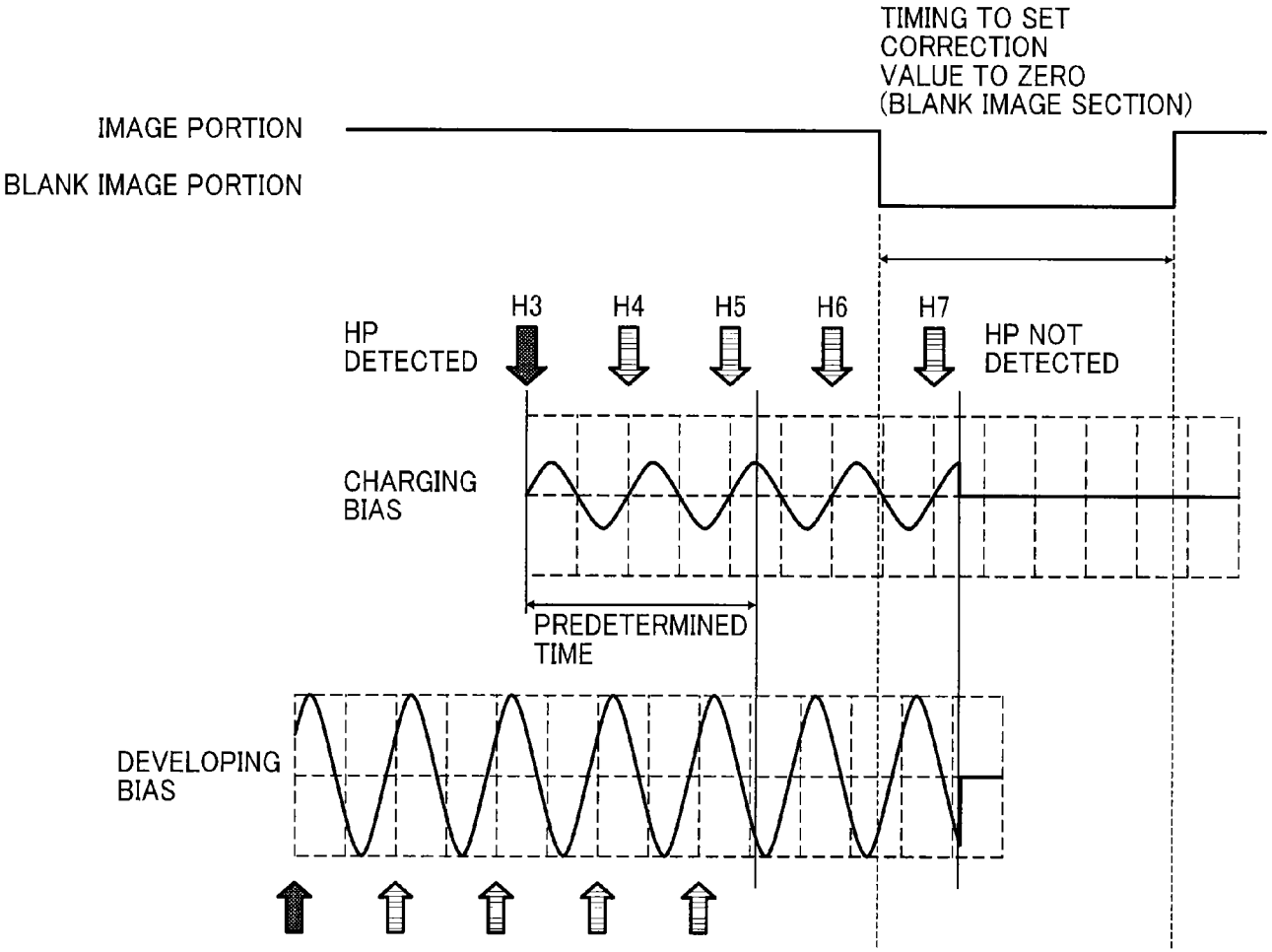
FIG. 29 illustrates another timing to stop the correction control in the present embodiment.

FIG. 29 illustrates another timing to stop the correction control in the present embodiment.

The example as illustrated in FIG. 29 shows that the correction control is not stopped during the charging process or the developing process is performed to one image. Specifically, the timing to stop the correction control is set at the blank image section between an image and the other. Even in this example, the timing to stop the correction control of the charging bias is earlier than the timing to stop the correction control of the developing bias by the moving time t from the charging position to the developing area. According to the present example, the correction value at the stop timing of the correction control is not considered, thereby enabling a relatively easy control.

Next, a timing to generate a correction table will be described.

Figure 30:
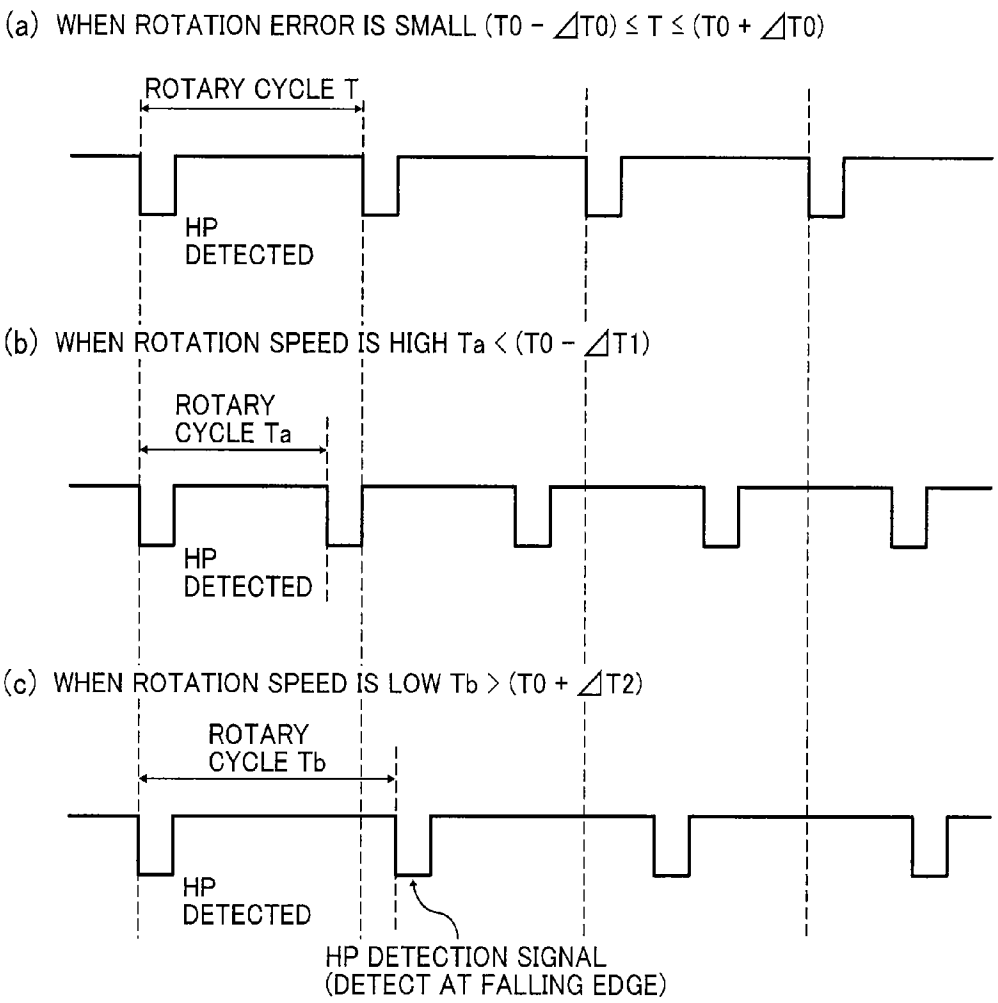
FIGS. 30(*a*) to 30(*c*) are explanatory views illustrating a timing to generate a correction table.

FIGS. 30(*a*) to 30(*c*) are explanatory views illustrating a timing to generate a correction table.

FIG. 30(*a*) shows a case in which the rotation error of the photoreceptor drum or the developing roller is small, and more specifically, one rotation time T of the current photoreceptor drum is within an error range of ±ΔT0 relative to the one rotation time T0 when generating the toner pattern for correction, detecting and generating the current correction table. In this case, an error between the correction value fluctuation cycle of the correction table and the rotary cycle of the photoreceptor drum is small, and each correction value of the correction table and the related rotation position of the photoreceptor drum is small, and thus, the image density fluctuation component of the rotary cycle of the photoreceptor drum may be appropriately reduced.

On the other hand, FIG. 30(*b*) shows a case in which one rotation time T of the current photoreceptor drum is shorter by AT1 than the one rotation time T0 of the photoreceptor drum when the current correction table was generated. FIG. 30(*c*) shows a case in which one rotation time T of the current photoreceptor drum is longer by AT2 than the one rotation time T0 of the photoreceptor drum when the current correction table was generated.

As in the cases of FIGS. 30B and 30C, when the error between one rotation time T of the current photoreceptor drum and the one rotation time T0 of the photoreceptor drum when the current correction table was generated is large, the error between the fluctuation cycle of the correction value in the correction table and the rotary cycle of the photoreceptor drum becomes large. As a result, a related error between each correction value in the correction table and the rotary position of the photoreceptor drum becomes large, so that the image density fluctuation component of the rotary cycle of the photoreceptor drum cannot be corrected appropriately and an image density fluctuation may be newly generated.

Accordingly, in the present embodiment, when the error between the one rotation time T of the current photoreceptor drum and the one rotation time T0 of the photoreceptor drum when the current correction table was generated exceeds an admissible range, the toner pattern for correction is newly generated and detection is performed to generate a new correction table. The admissible ranges ΔT1 and ΔT2 are determined by experiments varying the rotational speed and measuring and visually inspecting the fluctuation level of the image density fluctuation.

Preferred embodiments of the present invention have been described heretofore; however, the present invention is not limited to the described embodiments and various modification are possible within the scope of claims unless explicitly limited in the description. For example, the image forming apparatus to which the present invention is applied may be a copier, a printer, a facsimile machine, a plotter, and a multifunction apparatus having at least two functions of the above devices in combination such as a color digital apparatus enabling image formation of a full color image. Recently, color image formable image forming apparatuses are popular due to demands in the market; however, the image forming apparatus to which the present invention is applied may be a monochrome one. Such image forming apparatuses are preferably of the type capable of employing, as a recording medium on which image formation is performed, a regular sheet of paper, an OHP sheet, thick sheet such as a card, a postcard, or an envelope. Such image forming apparatuses may be of a type in which only single-side printing is possible. Developer to be used in such image forming apparatuses may be of one-component type developer and otherwise two-component type developer. Effects described in the present embodiments may be an example of the most optimal ones, and the effects of the present invention are not limited to the disclosed embodiments.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image carrier;

a rotary member;

an image forming unit to form a toner image on a surface of the image carrier to ultimately transfer the toner image onto a recording medium, wherein the image forming unit forms a toner pattern having a length greater than a circumference of the rotary member on the surface of the image carrier for use in detecting image density of a formed image;

a processor for controlling the image forming unit using predetermined image forming condition setting data;

an image density sensor to detect image density of the toner pattern formed on the surface of the image carrier;

a reference rotary position detector to detect a reference rotary position of the rotary member of the image forming unit;

an image density fluctuation data acquisition unit to obtain an image density fluctuation data of more than one circumferential length of the rotary member with reference to the reference rotary position detected by the reference rotary position detector based on the image density of the toner pattern formed on the image carrier detected by the image density sensor; and a correction data generator to generate correction data to correct reference image forming condition setting data by a correction amount corresponding to each rotary position of the rotary member to reduce image density fluctuation of one rotary cycle of the rotary member obtained by the image density fluctuation data with reference to the reference rotary position, wherein the processor starts to control image formation in accordance with the image forming condition setting data after correction by the correction data each time the reference rotary position detector detects the reference rotary position of the rotary member a predetermined number of times at a control start timing based on the detected timing, wherein, when the reference rotary position detector does not detect the reference rotary position of the rotary member by a time of a correction control stop timing to complete the image forming control arrives, the processor starts image forming control in accordance with the image forming condition setting data after correction following the control stop timing.

2. The image forming apparatus as claimed in claim 1, wherein:

the correction data comprises correction table data and the correction data generator comprises a correction table storage unit to store a generated correction table;

the correction table contains correction values, in which each correction value to correct the reference image forming condition setting data is related to a corresponding rotary position of the rotary member based on the reference rotary position;

each time the reference rotary position detector detects a reference rotary position of the rotary member a predetermined number of times, the processor sequentially corrects the image forming condition setting data with the correction value in the correction table data related to each rotary position at the control start timing; and when the reference rotary position detector does not detect the reference rotary position of the rotary member by the time the control stop timing to complete the image forming control with the correction value in the correction table data related to a final rotary position arrives, the processor starts image forming control in accordance with the image forming condition setting data after correction following the control stop timing.

3. The image forming apparatus as claimed in claim 1, wherein the image carrier is formed of a rotary member, and the correction data includes a correction value to reduce the image density fluctuation of one rotary cycle of the image carrier.

4. The image forming apparatus as claimed in claim 1, wherein:

the image forming unit includes a developing unit, the developing unit includes a rotary developer roller disposed opposite and in a vicinity of the surface of the image carrier and develops a latent image formed on the surface of the image carrier with a developing agent deposited on a surface of a developer carrier to render the latent image as a toner image; and the correction data includes a correction value to reduce image density fluctuation of one rotary cycle of the developer carrier.

5. The image forming apparatus as claimed in claim 1, wherein:

the image forming unit comprises a charger to electrically charge the surface of the image carrier; a latent image forming unit to form a latent image on the surface of the image carrier charged by the charger; and a developing unit to develop, with a developing agent, the latent image formed on the image carrier to render it a toner image; and the image forming condition setting data corrected by the correction data is setting data to control at least one of the charger, the latent image forming unit, and the developing unit.

6. The image forming apparatus as claimed in claim 1, wherein, when the reference rotary position of the rotary member is not detected by the reference rotary position detector after a predetermined time has elapsed after the control stop timing has come, the processor controls on the image forming operation according to the image forming condition setting data not corrected by the correction value to reduce the image density fluctuation of one rotary cycle of the rotary member.

7. The image forming apparatus as claimed in claim 6, wherein the correction data includes correction data to reduce image density fluctuation of one rotary cycle of two rotary members forming the image forming unit, the image forming apparatus further comprising a plurality of reference rotary position detectors to detect respective reference rotary position of the two rotary members, wherein, when the reference rotary position of the rotary members is not detected by one of the plurality of reference rotary position detectors after a predetermined time has elapsed after the control stop timing has come, the processor excludes correction data to reduce the image density fluctuation of one rotary cycle of one of the rotary members, and controls on the image forming operation according to the image forming condition setting data after correction using the correction data to reduce the image density fluctuation of one rotary cycle of the other of the rotary members.

8. The image forming apparatus as claimed in claim 6, wherein, when the reference rotary position of the rotary member is not detected by the reference rotary position detector after a predetermined time has elapsed after the control stop timing, the processor switches control of the image forming operation from the image forming operation in accordance with the image forming condition setting data after correction to the image forming condition setting data not corrected by the correction data to reduce the image density fluctuation of one rotary cycle of the rotary member at a timing when the rotary member positions at a rotary position where the correction value is less than a reference value.

9. The image forming apparatus as claimed in claim 6, wherein, when the reference rotary position of the rotary member is not detected by the reference rotary position detector after a predetermined time has elapsed after the control stop timing has come, the processor performs the image forming operation in accordance with the image forming condition setting data after correction, and then switches control of the image forming operation from the image forming operation in accordance with the image forming condition setting data after correction to the image forming condition setting data not corrected by the correction data to reduce the image density fluctuation of one rotary cycle of the rotary member during a blank image forming operation until the image forming unit performs a subsequent image forming operation.

10. The image forming apparatus as claimed in claim 1, wherein:

the image density fluctuation data acquisition unit obtains the image density fluctuation data when an error in a time interval in which the reference rotary position detector detects the reference rotary position of the rotary member exceeds an admissible range; and the correction data generator generates the correction data when the image density fluctuation data acquisition unit obtains the image density fluctuation data.

* * * * *